US011048183B2

(12) United States Patent
Watanabe et al.

(10) Patent No.: US 11,048,183 B2
(45) Date of Patent: Jun. 29, 2021

(54) ELECTROSTATIC-IMAGE DEVELOPING TONER, ELECTROSTATIC-IMAGE DEVELOPER, TONER CARTRIDGE, PROCESS CARTRIDGE, IMAGE FORMING APPARATUS, AND IMAGE FORMING METHOD

(71) Applicant: FUJIFILM Business Innovation Corp., Tokyo (JP)

(72) Inventors: Takuro Watanabe, Kanagawa (JP); Yoshimasa Fujihara, Kanagawa (JP); Daisuke Noguchi, Kanagawa (JP); Shintaro Anno, Kanagawa (JP); Satoshi Miura, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/781,134

(22) Filed: Feb. 4, 2020

(65) Prior Publication Data

US 2021/0072657 A1 Mar. 11, 2021

(30) Foreign Application Priority Data

Sep. 9, 2019 (JP) ..... JP2019-163564

(51) Int. Cl.

| | |
|---|---|
| ***G03G 9/08*** | (2006.01) |
| ***G03G 9/097*** | (2006.01) |
| ***G03G 15/08*** | (2006.01) |
| ***G03G 21/18*** | (2006.01) |

(52) U.S. Cl.

CPC ..... *G03G 9/09716* (2013.01); *G03G 9/0819* (2013.01); *G03G 9/0825* (2013.01); *G03G 9/09725* (2013.01); *G03G 9/09775* (2013.01); *G03G 15/0865* (2013.01); *G03G 21/18* (2013.01)

(58) Field of Classification Search

CPC ..... G03G 9/09716; G03G 9/09725; G03G 9/0819

USPC ..... 430/108.6, 111.4

See application file for complete search history.

(56) References Cited

U.S. PATENT DOCUMENTS

| | | | | |
|---|---|---|---|---|
| 9,519,233 | B2 * | 12/2016 | Srinivasan | G03G 9/09708 |
| 2010/0040968 | A1 * | 2/2010 | Bejat | G03G 9/09725 430/108.6 |
| 2018/0196366 | A1 * | 7/2018 | Watanabe | G03G 9/0821 |

FOREIGN PATENT DOCUMENTS

JP 2014-114175 A 6/2014

* cited by examiner

*Primary Examiner* — Mark A Chapman

(74) *Attorney, Agent, or Firm* — Sughrue Mion, PLLC

(57) ABSTRACT

An electrostatic-image developing toner includes toner particles, aggregated silica particles A treated with an oil, and aggregated or non-aggregated silica particles B rendered hydrophobic with a hydrophobizing agent other than an oil. The average particle size Da of the aggregated silica particles A and the average particle size Db of the silica particles B satisfy Da≥Db. The electrostatic-image developing toner does not include any external additive other than the aggregated silica particles A or the silica particles B, or the electrostatic-image developing toner includes an external additive other than the aggregated silica particles A or the silica particles B, the other external additive having an average particle size smaller than the average particle size Da.

21 Claims, 3 Drawing Sheets

ELECTROSTATIC-IMAGE DEVELOPING TONER, ELECTROSTATIC-IMAGE DEVELOPER, TONER CARTRIDGE, PROCESS CARTRIDGE, IMAGE FORMING APPARATUS, AND IMAGE FORMING METHOD

CROSS-REFERENCE TO RELATED APPLICATIONS

This application is based on and claims priority under 35 USC 119 from Japanese Patent Application No. 2019-163564 filed Sep. 9, 2019.

BACKGROUND

(i) Technical Field

The present disclosure relates to an electrostatic-image developing toner, an electrostatic-image developer, a toner cartridge, a process cartridge, an image forming apparatus, and an image forming method.

(ii) Related Art

Japanese Laid Open Patent Application Publication No. 2014-114175 discloses hydrophobic-surface spherical silica particles, wherein the primary particles of the spherical silica particles have an average particle size of 0.01 to 5 μm in terms of volume median diameter and at least a part of the surfaces of the spherical silica particles are rendered hydrophobic and a toner that includes the hydrophobic-surface spherical silica particles as an external additive.

SUMMARY

Aspects of non-limiting embodiments of the present disclosure relate to an electrostatic-image developing toner that may be readily discharged from a replacement toner accommodating unit compared with an electrostatic-image developing toner that includes aggregated silica particles A treated with an oil and aggregated or non-aggregated silica particles B rendered hydrophobic with a hydrophobizing agent other than an oil, wherein the average particle size Da of the aggregated silica particles A and the average particle size Db of the silica particles B satisfy Da<Db.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an electrostatic-image developing toner including toner particles, aggregated silica particles A treated with an oil, and aggregated or non-aggregated silica particles B rendered hydrophobic with a hydrophobizing agent other than an oil. An average particle size Da of the aggregated silica particles A and an average particle size Db of the silica particles B satisfy Da≥Db. The electrostatic-image developing toner does not include any external additive other than the aggregated silica particles A or the silica particles B, or the electrostatic-image developing toner includes an external additive other than the aggregated silica particles A or the silica particles B, the other external additive having an average particle size smaller than the average particle size Da.

BRIEF DESCRIPTION OF THE DRAWINGS

An exemplary embodiment of the present disclosure will be described in detail based on the following figures, wherein.

DETAILED DESCRIPTION

Figure 1:
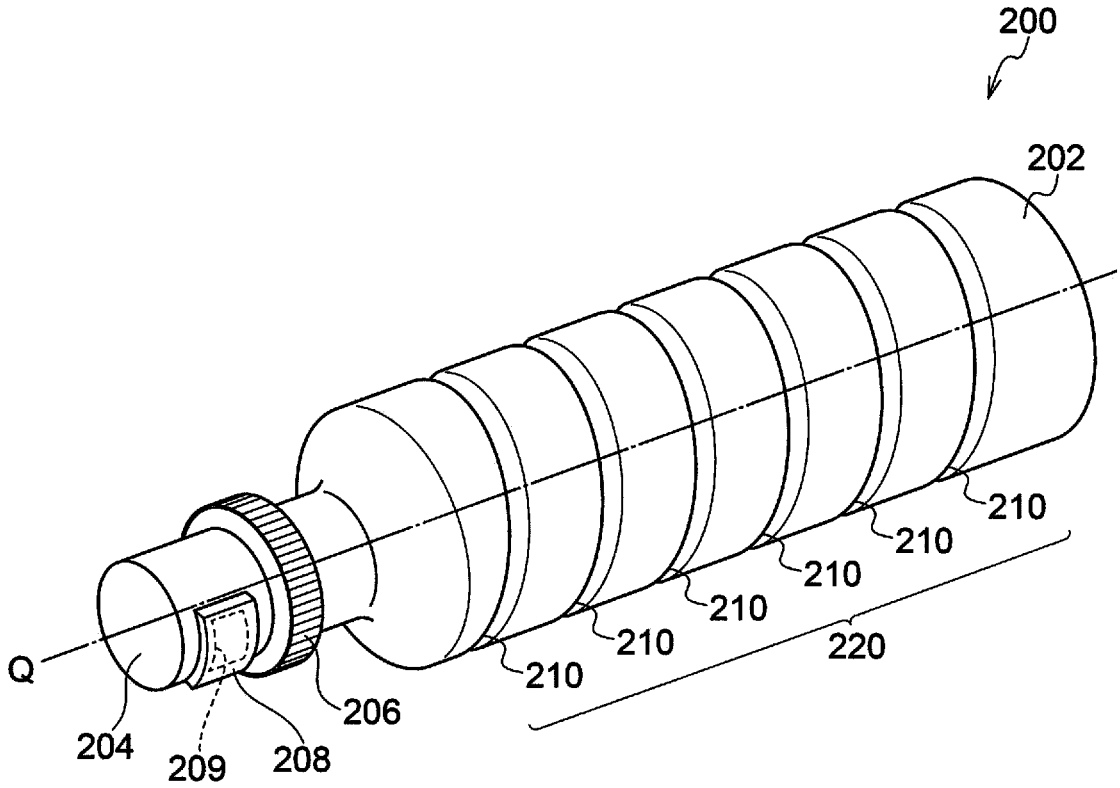
FIG. 1 is a schematic diagram illustrating an example of a toner cartridge according to an exemplary embodiment.

An exemplary embodiment of the present disclosure is described below. The following description and Examples below are intended to be illustrative of the exemplary embodiment and not restrictive of the scope of the exemplary embodiment.

In the present disclosure, a numerical range expressed using "to" means the range specified by the minimum and maximum described before and after "to", respectively.

In the present disclosure, when numerical ranges are described in a stepwise manner, the upper or lower limit of a numerical range may be replaced with the upper or lower limit of another numerical range, respectively. In the present disclosure, the upper and lower limits of a numerical range may be replaced with the upper and lower limits described in Examples below.

The term "step" used herein refers not only to an individual step but also to a step that is not distinguishable from other steps but achieves the intended purpose of the step.

In the present disclosure, when an exemplary embodiment is described with reference to a drawing, the structure of the exemplary embodiment is not limited to the structure illustrated in the drawing. The sizes of the members illustrated in the attached drawings are conceptual and do not limit the relative relationship among the sizes of the members.

Each of the components described in the present disclosure may include plural types of substances that correspond to the component. In the present disclosure, in the case where a composition includes plural substances that correspond to a component of the composition, the content of the component in the composition is the total content of the plural substances in the composition unless otherwise specified.

In the present disclosure, the number of types of particles that correspond to a component may be two or more. In the case where a composition includes plural types of particles that correspond to a component of the composition, the particle size of the component is the particle size of a mixture of the plural types of particles included in the composition unless otherwise specified.

In the present disclosure, an electrostatic-image developing toner may be referred to simply as "toner", and an electrostatic-image developer may be referred to simply as "developer".

Electrostatic-Image Developing Toner

A toner according to the exemplary embodiment is used in an electrophotographic image forming apparatus as a replacement toner that is to be fed into a developing unit.

The toner according to the exemplary embodiment may be used as a toner included in the developing unit.

The toner according to the exemplary embodiment includes toner particles, aggregated silica particles A treated with an oil, and aggregated or non-aggregated silica particles B rendered hydrophobic with a hydrophobizing agent other than an oil. The average particle size Da of the aggregated silica particles A and the average particle size Db of the silica particles B satisfy Da≥Db. The toner according to the exemplary embodiment does not include any external additive other than the aggregated silica particles A or the silica particles B, or the toner according to the exemplary embodiment includes an external additive other than the aggregated silica particles A or the silica particles B, the other external additive having an average particle size smaller than the average particle size Da.

The above-described toner according to the exemplary embodiment may be readily discharged from a replacement toner accommodating unit included in an image forming apparatus. The mechanisms for this are presumably as follows. Hereinafter, the external additive other than the aggregated silica particles A or the silica particles B is referred to as "external additive C".

Toner particles may adhere onto the inner surface of the replacement toner accommodating unit (e.g., a toner bottle) to reduce ease of discharging a toner. In particular, in the case where the replacement toner accommodating unit is a rotary toner bottle, which includes a helical protrusion formed in the inner surface of the bottle so as to enable a toner to be transported to a toner discharge port and commonly does not include any toner discharging mechanism other than the helical protrusion (e.g., an auger screw) disposed inside the bottle, the adhesion of toner particles on the inner surface of the bottle may significantly reduce ease of discharging a toner.

Accordingly, it is desirable to reduce the adhesion of toner particle onto the inner surface of the replacement toner accommodating unit for increasing ease of discharging a toner from the replacement toner accommodating unit.

Since the oil-treated aggregated silica particles A are aggregated silica particles having recesses formed in the surfaces, the aggregated silica particles A have features that (1) the aggregated silica particles A include a larger amount of oil deposited on the surfaces and (2) the aggregated silica particles A have more points at which the aggregated silica particles A come into contact with the inner surface of the replacement toner accommodating unit than non-aggregated silica particles treated with an oil. Furthermore, since Da≥Db, and the toner does not include the external additive C or the average particle size of the external additive C is smaller than Da, the aggregated silica particles A are the largest among the external additive particles and consequently form the outer edge of each toner particle.

It is considered that, since the aggregated silica particles A having the features (1) and (2) above form the outer edges of toner particles, a relatively large amount of oil migrates from the aggregated silica particles A onto the inner surface of the replacement toner accommodating unit and the oil deposited on the inner surface of the replacement toner accommodating unit inhibits the adhesion of toner particles onto the inner surface of the replacement toner accommodating unit.

However, if the silica particles used as an external additive are only oil-treated silica particles, the aggregation of toner particles is increased and, consequently, ease of discharging a replacement toner may be reduced. In order to address this issue, the silica particles B, which are silica particles that are not treated with an oil and rendered hydrophobic with a hydrophobizing agent other than an oil and satisfy Da≥Db, cover the surfaces of the toner particles so as to fill the gaps formed between the aggregated silica particles A. This may reduce the aggregation of the toner particles.

It is considered that, by the above-described mechanisms, the adhesion of the toner according to the exemplary embodiment onto the inner surface of the replacement toner accommodating unit and the aggregation of the toner particles may be reduced and, consequently, ease of discharging the toner from the replacement toner accommodating unit may be increased.

The aggregated silica particles A and the silica particles B may satisfy Da> Db in order to further increase ease of discharging the toner from the replacement toner accommodating unit.

The ratio Da/Db of the average particle size Da of the aggregated silica particles A to the average particle size Db of the silica particles B is preferably 1.0 or more and 2.0 or less, is more preferably more than 1.0 and 2.0 or less, and is further preferably 1.2 or more and 1.8 or less in order to further increase ease of discharging the toner from the replacement toner accommodating unit.

The mass ratio Ma/Mb of the content Ma of the aggregated silica particles A to the content Mb of the silica particles B is preferably 0.5 or more and 1.0 or less, is more preferably 0.55 or more and 0.95 or less, and is further preferably 0.6 or more and 0.9 or less in order to further increase ease of discharging the toner from the replacement toner accommodating unit.

Details of the components, structure, and properties of the toner according to the exemplary embodiment are described below.

Toner Particles

The toner particles include, for example, a binder resin and may optionally include a colorant, a release agent, and other additives.

Binder Resin

The toner particles may include, as binder resins, at least an amorphous resin and a crystalline polyester resin that is a polycondensate of a linear dicarboxylic acid and a linear dialcohol having 2 to 12 carbon atoms (hereinafter, this crystalline polyester resin is referred to as "specific crystalline polyester resin").

The term "crystalline" resin used herein refers to a resin that, in thermal analysis using differential scanning calorimetry (DSC), exhibits a distinct endothermic peak instead of step-like endothermic change and specifically refers to a resin that exhibits an endothermic peak with a half-width of 15° C. or less at a heating rate of 10° C./min. On the other hand, the term "amorphous" resin used herein refers to a resin that exhibits an endothermic peak with a half-width of more than 15° C., that exhibits step-like endothermic change, or that does not exhibit a distinct endothermic peak.

The binder resin may optionally include resins other than the above resins. The total content of the amorphous resin and the specific crystalline polyester resin is preferably 80% by mass or more, is more preferably 90% by mass or more, and is further preferably 95% by mass or more of the total amount of the resins included in the toner particles.

Amorphous Polyester Resin

Examples of the amorphous resin include an amorphous polyester resin.

Examples of the amorphous polyester resin include condensation polymers of a polyvalent carboxylic acid and a polyhydric alcohol. The amorphous polyester resin may be a commercially available one or a synthesized one.

Examples of the polyvalent carboxylic acid include aliphatic dicarboxylic acids, such as oxalic acid, malonic acid, maleic acid, fumaric acid, citraconic acid, itaconic acid, glutaconic acid, succinic acid, alkenyl succinic acid, adipic acid, and sebacic acid; alicyclic dicarboxylic acids, such as cyclohexanedicarboxylic acid; aromatic dicarboxylic acids, such as terephthalic acid, isophthalic acid, phthalic acid, and naphthalenedicarboxylic acid; anhydrides of these dicarboxylic acids; and lower (e.g., 1 to 5 carbon atoms) alkyl esters of these dicarboxylic acids. Among these dicarboxylic acids, for example, aromatic dicarboxylic acids may be used as a polyvalent carboxylic acid.

Trivalent or higher carboxylic acids having a crosslinked structure or a branched structure may be used as a polyvalent carboxylic acid in combination with the dicarboxylic acids. Examples of the trivalent or higher carboxylic acids include trimellitic acid, pyromellitic acid, anhydrides of these carboxylic acids, and lower (e.g., 1 to 5 carbon atoms) alkyl esters of these carboxylic acids.

The above polyvalent carboxylic acids may be used alone or in combination of two or more.

Examples of the polyhydric alcohol include aliphatic diols, such as ethylene glycol, diethylene glycol, triethylene glycol, propylene glycol, butanediol, pentanediol, hexanediol, and neopentyl glycol; alicyclic diols, such as cyclohexanediol, cyclohexanedimethanol, and hydrogenated bisphenol A; and aromatic diols, such as bisphenol A-ethylene oxide adduct and bisphenol A-propylene oxide adduct. Among these diols, for example, aromatic diols and alicyclic diols may be used as a polyhydric alcohol. In particular, aromatic diols may be used as a polyhydric alcohol.

Trihydric or higher alcohols having a crosslinked structure or a branched structure may be used as a polyhydric alcohol in combination with the diols. Examples of the trihydric or higher alcohols include glycerin, trimethylolpropane, and pentaerythritol.

The above polyhydric alcohols may be used alone or in combination of two or more.

The glass transition temperature Tg of the amorphous polyester resin is preferably 50° C. or more and 80° C. or less and is more preferably 50° C. or more and 65° C. or less.

The glass transition temperature is determined from a DSC curve obtained by differential scanning calorimetry (DSC). More specifically, the glass transition temperature is determined from the "extrapolated glass-transition-starting temperature" according to a method for determining glass transition temperature which is described in JIS K 7121: 1987 "Testing Methods for Transition Temperatures of Plastics".

The weight-average molecular weight Mw of the amorphous polyester resin is preferably 5,000 or more and 1,000,000 or less, is more preferably 7,000 or more and 500,000 or less, and is further preferably 30,000 or more and 150,000 or less.

The number-average molecular weight Mn of the amorphous polyester resin is preferably 2,000 or more and 100,000 or less.

The molecular weight distribution index Mw/Mn of the amorphous polyester resin is preferably 1.5 or more and 100 or less and is more preferably 2 or more and 60 or less.

The weight-average molecular weight and number-average molecular weight of the amorphous polyester resin are determined by gel permeation chromatography (GPC). Specifically, the molecular weights of the amorphous polyester resin are determined by GPC using a "HLC-8120GPC" produced by Tosoh Corporation as measuring equipment, a column "TSKgel SuperHM-M (15 cm)" produced by Tosoh Corporation, and a tetrahydrofuran (THF) solvent. The weight-average molecular weight and number-average molecular weight of the amorphous polyester resin are determined on the basis of the results of the measurement using a molecular-weight calibration curve based on monodisperse polystyrene standard samples.

The amorphous polyester resin may be produced by any suitable production method known in the related art. Specifically, the amorphous polyester resin may be produced by, for example, a method in which polymerization is performed at 180° C. or more and 230° C. or less, the pressure inside the reaction system is reduced as needed, and water and alcohols that are generated by condensation are removed.

In the case where the raw materials, that is, the monomers, are not dissolved in or miscible with each other at the reaction temperature, a solvent having a high boiling point may be used as a dissolution adjuvant in order to dissolve the raw materials. In such a case, the condensation polymerization reaction is performed while the dissolution adjuvant is distilled away. In the case where the monomers used in the copolymerization reaction have low miscibility with each other, a condensation reaction of the monomers with an acid or alcohol that is to undergo a polycondensation reaction with the monomers may be performed in advance and subsequently polycondensation of the resulting polymers with the other components may be performed.

Crystalline Polyester Resin

Examples of the crystalline polyester resin include condensation polymers of a polyvalent carboxylic acid and a polyhydric alcohol. The crystalline polyester resin may be commercially available one or a synthesized one.

In order to increase ease of forming a crystal structure, a condensation polymer prepared from linear aliphatic polymerizable monomers may be used as a crystalline polyester resin instead of a condensation polymer prepared from polymerizable monomers having an aromatic ring.

Examples of the polyvalent carboxylic acid include aliphatic dicarboxylic acids, such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid; aromatic dicarboxylic acids, such as dibasic acids (e.g., phthalic acid, isophthalic acid, terephthalic acid, and naphthalene-2,6-dicarboxylic acid); anhydrides of these dicarboxylic acids; and lower (e.g., 1 to 5 carbon atoms) alkyl esters of these dicarboxylic acids.

Trivalent or higher carboxylic acids having a crosslinked structure or a branched structure may be used as a polyvalent carboxylic acid in combination with the dicarboxylic acids. Examples of the trivalent carboxylic acids include aromatic carboxylic acids, such as 1,2,3-benzenetricarboxylic acid, 1,2,4-benzenetricarboxylic acid, and 1,2,4-naphthalenetricarboxylic acid; anhydrides of these tricarboxylic acids; and lower (e.g., 1 to 5 carbon atoms) alkyl esters of these tricarboxylic acids.

Dicarboxylic acids including a sulfonic group and dicarboxylic acids including an ethylenic double bond may be used as a polyvalent carboxylic acid in combination with the above dicarboxylic acids.

The above polyvalent carboxylic acids may be used alone or in combination of two or more.

Examples of the polyhydric alcohol include aliphatic diols, such as linear aliphatic diols including a backbone having 7 to 20 carbon atoms. Examples of the aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Among these aliphatic diols, 1,8-octanediol, 1,9-nonanediol, and 1,10-decanediol may be used.

Trihydric or higher alcohols having a crosslinked structure or a branched structure may be used as a polyhydric alcohol in combination with the above diols. Examples of the trihydric or higher alcohols include glycerin, trimethylolethane, trimethylolpropane, and pentaerythritol.

The above polyhydric alcohols may be used alone or in combination of two or more.

The content of the aliphatic diols in the polyhydric alcohol may be 80 mol % or more and is preferably 90 mol % or more.

The melting temperature of the crystalline polyester resin is preferably 50° C. or more and 100° C. or less, is more preferably 55° C. or more and 90° C. or less, and is further preferably 60° C. or more and 85° C. or less.

The melting temperature of the crystalline polyester resin is determined from the "melting peak temperature" according to a method for determining melting temperature which is described in JIS K 7121:1987 "Testing Methods for Transition Temperatures of Plastics" using a DSC curve obtained by differential scanning calorimetry (DSC).

The weight-average molecular weight Mw of the crystalline polyester resin is preferably 6,000 or more and 35,000 or less and is more preferably 7,000 or more and 15,000 or less.

The crystalline polyester resin may be produced by any suitable method known in the related art similarly to, for example, the amorphous polyester resin.

The content of the binder resin in the toner particles is preferably 40% by mass or more and 95% by mass or less, is more preferably 50% by mass or more and 90% by mass or less, and is further preferably 60% by mass or more and 85% by mass or less.

Colorant

Examples of the colorant include pigments, such as Carbon Black, Chrome Yellow, Hansa Yellow, Benzidine Yellow, Threne Yellow, Quinoline Yellow, Pigment Yellow, Permanent Orange GTR, Pyrazolone Orange, Vulcan Orange, Watching Red, Permanent Red, Brilliant Carmine 3B, Brilliant Carmine 6B, DuPont Oil Red, Pyrazolone Red, Lithol Red, Rhodamine B Lake, Lake Red C, Pigment Red, Rose Bengal, Aniline Blue, Ultramarine Blue, Calco Oil Blue, Methylene Blue Chloride, Phthalocyanine Blue, Pigment Blue, Phthalocyanine Green, and Malachite Green Oxalate; and dyes, such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes, and thiazole dyes.

The above colorants may be used alone or in combination of two or more.

The colorant may optionally be subjected to a surface treatment and may be used in combination with a dispersant. Plural types of colorants may be used in combination.

The content of the colorant in the toner particles is preferably 1% by mass or more and 30% by mass or less and is more preferably 3% by mass or more and 15% by mass or less.

Release Agent

Examples of the release agent include, but are not limited to, hydrocarbon waxes; natural waxes, such as a carnauba wax, a rice bran wax, and a candelilla wax; synthetic or mineral-petroleum-derived waxes, such as a montan wax; and ester waxes, such as a fatty-acid ester wax and a montanate wax.

The melting temperature of the release agent is preferably 50° C. or more and 110° C. or less and is more preferably 60° C. or more and 100° C. or less.

The melting temperature of the release agent is determined from the "melting peak temperature" according to a method for determining melting temperature which is described in JIS K 7121:1987 "Testing Methods for Transition Temperatures of Plastics" using a DSC curve obtained by differential scanning calorimetry (DSC).

The content of the release agent in the toner particles is preferably 1% by mass or more and 20% by mass or less and is more preferably 5% by mass or more and 15% by mass or less.

Other Additives

Examples of the other additives include additives known in the related art, such as a magnetic substance, a charge-controlling agent, and an inorganic powder. These additives may be added to the toner particles as internal additives.

Properties, etc. of Toner Particles

The toner particles may have a single-layer structure or a "core-shell" structure constituted by a core (i.e., core particle) and a coating layer (i.e., shell layer) covering the core.

The core-shell structure of the toner particles may be constituted by, for example, a core including a binder resin and, as needed, other additives such as a colorant and a release agent and by a coating layer including the binder resin.

The volume-average diameter D50v of the toner particles is preferably 2 μm or more and 10 μm or less and is more preferably 4 μm or more and 8 μm or less.

The above-described average diameters and particle diameter distribution indices of the toner particles are measured using "COULTER Multisizer II" (produced by Beckman Coulter, Inc.) with an electrolyte "ISOTON-II" (produced by Beckman Coulter, Inc.) in the following manner.

A sample to be measured (0.5 mg or more and 50 mg or less) is added to 2 ml of a 5 mass %-aqueous solution of a surfactant (e.g., sodium alkylbenzene sulfonate) that serves as a dispersant. The resulting mixture is added to 100 ml or more and 150 ml or less of an electrolyte.

The resulting electrolyte containing the sample suspended therein is subjected to a dispersion treatment for 1 minute using an ultrasonic disperser, and the distribution of the diameters of particles having a diameter of 2 μm or more and 60 μm or less is measured using COULTER Multisizer II with an aperture having a diameter of 100 μm. The number of the particles sampled is 50,000.

The particle diameter distribution measured is divided into a number of particle diameter ranges (i.e., channels). For each range, in ascending order in terms of particle diameter, the cumulative volume and the cumulative number are calculated and plotted to draw cumulative distribution curves. Particle diameters at which the cumulative volume and the cumulative number reach 16% are considered to be the volume particle diameter D16v and the number particle diameter D16p, respectively. Particle diameters at which the cumulative volume and the cumulative number reach 50% are considered to be the volume-average particle diameter D50v and the number-average particle diameter D50p, respectively. Particle diameters at which the cumulative volume and the cumulative number reach 84% are considered to be the volume particle diameter D84v and the number particle diameter D84p, respectively.

Using the volume particle diameters and number particle diameters measured, the volume grain size distribution index (GSDv) is calculated as $(D84v/D16v)^{1/2}$ and the number grain size distribution index (GSDp) is calculated as $(D84p/D16p)^{1/2}$.

The toner particles preferably has an average circularity of 0.94 or more and 1.00 or less. The average circularity of the toner particles is more preferably 0.95 or more and 0.98 or less.

Aggregated Silica Particles A

The aggregated silica particles A are aggregated silica particles treated with an oil.

Specific examples of the silica particles that constitute the aggregated silica particles A include gas-phase method silica particles, wet-process silica particles, and fused silica particles The hydrophobizing agent used for treating the aggregated silica particles A is an oil. Examples of the oil include a silicone oil, a paraffin oil, a fluorine oil, and a vegetable oil. The above oils may be used alone or in combination of two or more. Among the above oils, a silicone oil is preferable, and a dimethyl silicone oil is more preferable.

An oil treatment of silica particles may be performed by, for example, dispersing the silica particles in an oil dissolved in an alcohol, removing the alcohol by distillation using an evaporator, and performing drying.

The aggregated silica particles A may be the particles formed by aggregation of gas-phase method silica particles in order to form a relatively large number of recesses that serve as oil-holding portions in the surfaces of the particles. The gas-phase method silica particles are produced by, for example, burning silicon tetrachloride with hydrogen and oxygen.

The average particle size Da of the aggregated silica particles A is preferably 70 nm or more and 110 nm or less. When the average particle size Da is 70 nm or more, the effect of inhibiting the aggregation of the toner particles, that is, the spacer effect, may be enhanced. In this regard, the average particle size Da of the aggregated silica particles A is more preferably 75 nm or more and is further preferably 80 nm or more. When the average particle size Da is 110 nm or less, it becomes difficult to disintegrate the aggregated silica particles A. In this regard, the average particle size Da of the aggregated silica particles A is more preferably 105 nm or less and is further preferably 100 nm or less.

The average particle size Da of the aggregated silica particles A is determined by the measuring method described below.

First, the aggregated silica particles are separated from the toner particles. The separation of the aggregated silica particles is achieved using the property of the aggregated silica particles having a smaller adhesion to the toner particles than other external additive particles. For example, the toner is dispersed in water containing a surfactant to form a dispersion liquid. An ultrasonic wave (65 μm, 1 min, 20° C.) is applied to the dispersion liquid. Subsequently, the dispersion liquid is subjected to high-speed centrifugation. The resulting supernatant is dried at normal temperature (23° C.±2° C.) to obtain aggregated silica particles.

The aggregated silica particles are classified into aggregated silica particles treated with an oil (i.e., the aggregated silica particles A) and aggregated silica particles rendered hydrophobic with a hydrophobizing agent other than an oil. The two types of aggregated silica particles may be distinguished from each other by, for example, cleaning the aggregated silica particles included in the supernatant with tetrahydrofuran (THF) and calculating the change in the weight of the aggregated silica particles which occurs during the cleaning. Specifically, it is considered that the aggregated silica particles are treated with an oil when Wb-Wa is 0.20% by mass or more of Wb, where Wb is the weight of the aggregated silica particles that have not been cleaned with THF, and Wa is the weight of the aggregated silica particles cleaned with THF.

The average particle size Da of the aggregated silica particles A is determined by measuring the diameter (i.e., the average of major-axis length and minor-axis length) of each of 500 aggregated silica particles on the basis of the analysis of scanning electron microscope (SEM) images and taking the average thereof.

In an example of the exemplary embodiment, the particle-size number frequency distribution of the aggregated silica particles A has first and second peaks. The first peak occurs at a particle size of 80 nm or more and 110 nm or less. The second peak occurs at a particle size of 50 nm or more and 80 nm or less. In other words, in this example, the aggregated silica particles A are a mixture of first aggregated silica particles having an average particle size of 80 nm or more and 110 nm or less (hereinafter, referred to as "aggregated silica particles A1") and second aggregated silica particles having an average particle size of 50 nm or more and 80 nm or less (hereinafter, referred to as "aggregated silica particles A2").

The mixing ratio between the aggregated silica particles A1 and the aggregated silica particles A2 (by mass, A1:A2) is preferably 20:80 to 70:30, is more preferably 30:70 to 60:40, and is further preferably 40:60 to 50:50.

The amount of the aggregated silica particles A used as an external additive is preferably 0.1% by mass or more and 4% by mass or less, is more preferably 0.3% by mass or more and 2% by mass or less, and is further preferably 0.5% by mass or more and 1% by mass or less of the amount of the toner particles in order to further increase ease of discharging the toner from the replacement toner accommodating unit.

The coverage of the aggregated silica particles A on the surfaces of the toner particles is preferably 5% or more and 30% or less, is more preferably 8% or more and 28% or less, and is further preferably 10% or more and 25% or less in order to further increase ease of discharging the toner from the replacement toner accommodating unit.

The coverage of the aggregated silica particles A on the surfaces of the toner particles is determined by analyzing an electron microscope image of the toner.

Specifically, the surfaces of the toner particles are observed with a scanning electron microscope S-4700 produced by Hitachi, Ltd. at a 10,000-fold magnification in 100 fields of view. The images of the surfaces of toner particles are analyzed with an area analysis tool included in an image processing/analysis software WinROOF produced by MITANI CORPORATION. The coverage of the aggregated silica particles A on the surfaces of the toner particles is determined by calculating the area of portions of the surfaces of the toner particles on which the aggregated silica particles are deposited, the area of portions of the surfaces of the toner particles on which the other external additive particles are deposited, and the area of portions of the surfaces of the toner particles on which any external additive particles are not deposited. Whether or not the external additive particles are silica particles may be determined by SEM-EDX. The aggregated silica particles deposited on the toner particles which are distinguished as oil-treated aggregated silica particles in the above-described method for measuring the average particle size Da may be considered the aggregated silica particles A.

Silica Particles B

The silica particles B are silica particles rendered hydrophobic with a hydrophobizing agent other than an oil and include both aggregated silica particles and non-aggregated silica particles. The silica particles B are silica particles that are not treated with an oil.

The hydrophobizing agent used for treating the silica particles B is not limited and may be any hydrophobizing agent other than an oil. The hydrophobizing agent is preferably a silazane compound, such as dimethyldisilazane, trimethyldisilazane, tetramethyldisilazane, pentamethyldisilazane, or hexamethyldisilazane, and is particularly preferably 1,1,1,3,3,3-hexamethyldisilazane (HMDS). The above hydrophobizing agents may be used alone or in combination of two or more.

The silica particles B may be particles having a high degree of circularity in order to inhibit the aggregation of the toner particles. Accordingly, the silica particles B may be wet-process silica particles and non-aggregated silica particles. The average circularity of the silica particles B may be 0.94 or more. The circularity of particles is $4\pi\times$[Area of particle image]/[Perimeter of particle image)$^{1/2}$. The maximum circularity is 1. The average circularity of particles is determined by observing at least 300 particles with a microscope.

The silica particles B may be the non-aggregated silica particles produced by rendering wet-process silica particles hydrophobic with 1,1,1,3,3,3-hexamethyldisilazane.

Wet-process silica particles may be produced by, for example, the following method.

Tetraalkoxysilane is added dropwise to an alkali catalyst solution containing an alcohol compound and ammonia water to cause hydrolysis and condensation of tetraalkoxysilane and form a suspension containing sol gel silica particles. The solvent is removed from the suspension to obtain particulate matter. The particulate matter is dried to form sol gel silica particles. The average primary particle size of the sol gel silica particles may be controlled by adjusting the proportion of the amount of the tetraalkoxysilane used to the amount of the alkali catalyst solution used.

The average particle size Db of the silica particles B is preferably 20 nm or more and 80 nm or less. When the average particle size Db is 20 nm or more, the likelihood of the silica particles B being buried in the toner particles may be reduced. In this regard, the average particle size Db of the silica particles B is more preferably 25 nm or more and is further preferably 30 nm or more. When the average particle size Db is 80 nm or less, the likelihood of the silica particles B rolling on the surfaces of the toner particles is relatively low and the likelihood of the silica particles B being unevenly distributed in the recesses formed in the surfaces of the toner particles is low. In this regard, the average particle size Db of the silica particles B is more preferably 75 nm or less and is further preferably 70 nm or less.

The average particle size Db of the silica particles B is determined by the measuring method described below.

First, the aggregated silica particles are separated from the toner particles. The separation of the aggregated silica particles is achieved using the property of the aggregated silica particles having a smaller adhesion to the toner particles than other external additive particles. For example, the toner is dispersed in water containing a surfactant to form a dispersion liquid. An ultrasonic wave (65 μm, 1 min, 20° C.) is applied to the dispersion liquid. Subsequently, the dispersion liquid is subjected to high-speed centrifugation. The resulting supernatant (1) is dried at normal temperature (23° C.±2° C.) to obtain aggregated silica particles.

The aggregated silica particles are classified into aggregated silica particles treated with an oil (i.e., the aggregated silica particles A) and aggregated silica particles rendered hydrophobic with a hydrophobizing agent other than an oil (i.e., aggregated silica particles B). The two types of aggregated silica particles may be distinguished from each other by, for example, cleaning the aggregated silica particles included in the supernatant (1) with tetrahydrofuran (THF) and calculating the change in the weight of the aggregated silica particles which occurs during the cleaning. Specifically, it is considered that the aggregated silica particles are not treated with an oil when Wb-Wa is less than 0.20% by mass of Wb, where Wb is the weight of the aggregated silica particles that have not been cleaned with THF, and Wa is the weight of the aggregated silica particles cleaned with THF.

The average particle size of the aggregated silica particles B is determined by measuring the diameter (i.e., the average of major-axis length and minor-axis length) of each of 500 aggregated silica particles on the basis of the analysis of scanning electron microscope (SEM) images and taking the average thereof.

After the separation of the aggregated silica particles from the toner, the toner is again dispersed in water containing a surfactant to form a dispersion liquid. An ultrasonic wave (160 μm, 60 min, 20° C.) is applied to the dispersion liquid. Subsequently, the dispersion liquid is subjected to high-speed centrifugation. The resulting supernatant (2) is dried at normal temperature (23° C.±2° C.) to obtain non-aggregated silica particles.

The non-aggregated silica particles are classified into non-aggregated silica particles treated with an oil and non-aggregated silica particles rendered hydrophobic with a hydrophobizing agent other than an oil (i.e., non-aggregated silica particles B). The two types of non-aggregated silica particles may be distinguished from each other by, for example, cleaning the non-aggregated silica particles included in the supernatant (2) with THF and calculating the change in the weight of the non-aggregated silica particles which occurs during the cleaning. Specifically, it is considered that the non-aggregated silica particles are not treated with an oil when Wb-Wa is less than 0.20% by mass of Wb, where Wb is the weight of the non-aggregated silica particles that have not been cleaned with THF, and Wa is the weight of the non-aggregated silica particles cleaned with THF.

The average particle size of the non-aggregated silica particles B is determined by measuring the diameters (i.e., the average of major-axis length and minor-axis length) of 500 silica particles on the basis of the analysis of scanning electron microscope (SEM) images and taking the average thereof.

The average particle size Db of the silica particles B is the average of the average particle size of the aggregated silica particles B and the average particle size of the non-aggregated silica particles B weighted by number proportion.

The BET specific surface area of the silica particles B is preferably 100 $m^2/g$ or more and 240 $m^2/g$ or less, is more preferably 120 $m^2/g$ or more and 220 $m^2/g$ or less, and is further preferably 150 $m^2/g$ or more and 200 $m^2/g$ or less. The BET specific surface area of the silica particles B is measured by a multipoint BET method using a nitrogen gas.

The amount of the silica particles B used as an external additive is 0.1% by mass or more and 5% by mass or less, is more preferably 0.3% by mass or more and 3% by mass or less, and is further preferably 0.5% by mass or more and 2% by mass or less of the amount of the toner particles in order to increase ease of discharging the toner from the replacement toner accommodating unit.

Other External Additive

The toner according to the exemplary embodiment does not include any external additive other than the aggregated silica particles A or the silica particles B. In another case, the toner includes an external additive other than the aggregated silica particles A or the silica particles B and the other external additive has an average particle size smaller than the average particle size Da of the aggregated silica particles A.

Examples of the external additive other than the aggregated silica particles A or the silica particles B include inorganic particles, such as $TiO_2$ particles, $Al_2O_3$ particles, CuO particles, ZnO particles, $SnO_2$ particles, $CeO_2$ particles, $Fe_2O_3$ particles, MgO particles, BaO particles, CaO particles, $K_2O$ particles, $Na_2O$ particles, $ZrO_2$ particles, $CaO\times SiO_2$ particles, $K_2O\times (TiO_2)$, particles, $Al_2O_3.2SiO_2$ particles, $CaCO_3$ particles, $MgCO_3$ particles, $BaSO_4$ particles, and $MgSO_4$ particles.

The surfaces of the inorganic particles used as an external additive may be subjected to a hydrophobic treatment. The hydrophobic treatment is performed by, for example, immersing the inorganic particles in a hydrophobizing agent. Examples of the hydrophobizing agent include, but are not limited to, a silane coupling agent, a silicone oil, a titanate coupling agent, and aluminum coupling agent. These hydrophobizing agents may be used alone or in combination of two or more. The amount of the hydrophobizing agent is commonly, for example, 1 part by mass or more and 10 parts by mass or less relative to 100 parts by mass of the inorganic particles.

Examples of the external additive other than the aggregated silica particles A or the silica particles B further include particles of a resin, such as polystyrene, polymethyl methacrylate, or a melamine resin; and particles of a cleaning lubricant, such as a metal salt of a higher fatty acid, such as zinc stearate, or a fluorine-based high-molecular-weight compound.

In the case where the toner according to the exemplary embodiment includes an external additive other than the aggregated silica particles A or the silica particles B, the amount of the other external additive used is preferably 0.01% by mass or more and 5% by mass or less and is more preferably 0.01% by mass or more and 2.0% by mass or less of the amount of the toner particles.

The toner according to the exemplary embodiment may include an external additive other than the aggregated silica particles A or the silica particles B. The toner according to the exemplary embodiment does not necessarily include the other external additive.

The coverage of all the external additives on the surfaces of the toner particles is preferably 60% or more and 100% or less, is more preferably 70% or more and 100% or less, and is further preferably 80% or more and 100% or less in order to increase ease of discharging the toner from the replacement toner accommodating unit.

The coverage of all the external additives on the surfaces of the toner particles is measured by the following method.

(1) The toner is dispersed in an epoxy resin. The resulting dispersion liquid is left to stand for a whole day and night to solidify. Hereby, a test sample is prepared. The epoxy resin is, for example, a two-component epoxy resin.

(2) A slice having a thickness of 100 nm is cut from the test sample with a microtome.

(3) The slice is placed on a copper mesh, which is then attached to a high-resolution electron microscope "JEM-2010" produced by JEOL Ltd. An image of the slice is taken at an applied voltage of 200 kV at a 500,000-fold magnification.

(4) The resulting negative is enlarged 3 to 10 times and printed.

(5) On the printed image formed by the steps (1) to (4), the surfaces of toner particles having a diameter equal to 80% or more and 120% or less of the volume-average particle size of the toner are observed. The coverage of all the external additives on the surfaces of the toner particles is determined. The coverage is calculated using the following formula.

$$\text{Coverage}=[\text{Length of coating}/\text{Length of outer perimeter of toner particle}]\times 100(\%)$$

where "Length of coating" refers to the length of the external additive layer disposed directly on the surface of a toner particle. In this exemplary embodiment, the average of the coverages calculated for 10 toner particles is used.

In the particle-size number frequency distribution of all the external additives, the proportion of particles having a size of 20 nm or more and 100 nm or less is preferably 75% or more and 100% or less, is more preferably 80% or more and 100% or less, is further preferably 85% or more and 100% or less, and is most preferably 90% or more and 100% or less in order to increase ease of discharging the toner from the replacement toner accommodating unit. Low-Molecular-Weight Siloxane Having Molecular Weight of 200 or More and 600 or Less The toner according to the exemplary embodiment may include a low-molecular-weight siloxane having a molecular weight of 200 or more and 600 or less which consists of a siloxane bond and an alkyl group.

The term "siloxane" used herein refers to a siloxane consisting of a siloxane bond and an alkyl group unless otherwise specified. In the present disclosure, siloxanes having a molecular weight of less than 1,000 are categorized as low-molecular-weight siloxanes, while siloxanes having a molecular weight of 1,000 or more are categorized as silicone oils.

A part or the entirety of the low-molecular-weight siloxane having a molecular weight of 200 or more and 600 or less may be adhered to a part or the entirety of the silica particles that serve as an external additive. In the case where the silica particles are hydrophobic silica particles that have been subjected to a hydrophobic surface treatment, a part or the entirety of the low-molecular-weight siloxane having a molecular weight of 200 or more and 600 or less may be adhered to a part or the entirety of the silica particles that have been subjected to the hydrophobic treatment.

It is considered that the low-molecular-weight siloxane having a molecular weight of 200 or more and 600 or less causes the oil deposited on the surfaces of the aggregated silica particles A to be released and migrate onto the inner surface of the replacement toner accommodating unit.

The molecular weight of the low-molecular-weight siloxane included in the toner according to the exemplary embodiment is preferably 200 or more, is more preferably 250 or more, is further preferably 280 or more, and is most preferably 300 or more in order to facilitate the migration of the released oil.

The molecular weight of the low-molecular-weight siloxane included in the toner according to the exemplary embodiment is preferably 600 or less, is more preferably 550 or less, is further preferably 500 or less, and is most preferably 450 or less in order to reduce the likelihood of the siloxane molecules becoming entangled with one another to form clusters; if the molecular weight of the low-molecular-weight siloxane is relatively high, the likelihood of the siloxane molecules becoming entangled with one another to form clusters is increased.

The toner according to the exemplary embodiment may include at least one selected from a low-molecular-weight siloxane having a molecular weight of less than 200, a low-molecular-weight siloxane having a molecular weight of more than 600 and less than 1,000, and a silicone oil having a molecular weight of 1,000 or more such that the intended effects of the toner according to the exemplary embodiment are not impaired.

The number of Si atoms included in a molecule of the low-molecular-weight siloxane having a molecular weight of 200 or more and 600 or less is at least two.

The number of Si atoms included in a molecule of the low-molecular-weight siloxane having a molecular weight of 200 or more and 600 or less is preferably 3 or more, is more preferably 4 or more, and is further preferably 5 or more in order to facilitate the migration of the released oil.

The number of Si atoms included in a molecule of the low-molecular-weight siloxane having a molecular weight of 200 or more and 600 or less is preferably 7 or less, is more preferably 6 or less, and is further preferably 5 or less in order to reduce the likelihood of the siloxane molecules becoming entangled with one another to form clusters.

In consideration of the above two points, the number of Si atoms included in a molecule of the low-molecular-weight siloxane having a molecular weight of 200 or more and 600 or less is particularly preferably 5.

The kinematic viscosity of the low-molecular-weight siloxane having a molecular weight of 200 or more and 600 or less at 25° C. may be 2 $mm^2/s$ or more and 5 $mm^2/s$ or less in order to facilitate the migration of the released oil. In the exemplary embodiment, the kinematic viscosity ($mm^2/s$) of a siloxane is determined by dividing the viscosity of the siloxane at 25° C. which is measured with an Ostwald viscometer (a type of a capillary viscometer) by the density of the siloxane.

An example of the low-molecular-weight siloxane having a molecular weight of 200 or more and 600 or less is a linear siloxane that includes a siloxane bond that is not branched.

Examples of a linear low-molecular-weight siloxane having a molecular weight of 200 or more and 600 or less include hexaalkyldisiloxane, octaalkyltrisiloxane, decaalkyltetrasiloxane, dodecaalkylpentasiloxane, tetradecaalkylhexasiloxane, and hexadecaalkylheptasiloxane (note that, the above siloxanes have a molecular weight of 200 or more and 600 or less).

Examples of the alkyl group included in the above linear low-molecular-weight siloxanes include a linear alkyl group having 1 to 10 carbon atoms (preferably having 1 to 6 carbon atoms, more preferably having 1 to 3 carbon atoms, and further preferably having 1 or 2 carbon atoms); a branched alkyl group having 3 to 10 carbon atoms (preferably having 3 to 6 carbon atoms and more preferably having 3 or 4 carbon atoms); and a cyclic alkyl group having 3 to 10 carbon atoms (preferably having 3 to 6 carbon atoms and more preferably having 3 or 4 carbon atoms). Among these, an alkyl group having 1 to 3 carbon atoms is preferable, at least one of a methyl group and an ethyl group is more preferable, and a methyl group is further preferable. The plural alkyl groups included in a molecule of the linear low-molecular-weight siloxane may be identical to or different from one another.

Specific examples of the linear low-molecular-weight siloxane having a molecular weight of 200 or more and 600 or less include octamethyltrisiloxane, decamethyltetrasiloxane, dodecamethylpentasiloxane, tetradecamethylhexasiloxane, and hexadecamethylheptasiloxane.

An example of the low-molecular-weight siloxane having a molecular weight of 200 or more and 600 or less is a branched siloxane that includes a branched siloxane bond.

Examples of a branched low-molecular-weight siloxane having a molecular weight of 200 or more and 600 or less include branched siloxanes such as 1,1,1,3,5,5,5-heptaalkyl-3-(trialkylsiloxy)trisiloxane, tetrakis(trialkylsiloxy)silane, and 1,1,1,3,5,5,7,7,7-nonaalkyl-3-(trialkylsiloxy)tetrasiloxane (note that, the above siloxanes have a molecular weight of 200 or more and 600 or less).

Examples of the alkyl group included in the above branched low-molecular-weight siloxanes include a linear alkyl group having 1 to 10 carbon atoms (preferably having 1 to 6 carbon atoms, more preferably having 1 to 3 carbon atoms, and further preferably having 1 or 2 carbon atoms); a branched alkyl group having 3 to 10 carbon atoms (preferably having 3 to 6 carbon atoms and more preferably having 3 or 4 carbon atoms); and a cyclic alkyl group having 3 to 10 carbon atoms (preferably having 3 to 6 carbon atoms and more preferably having 3 or 4 carbon atoms). Among these, an alkyl group having 1 to 3 carbon atoms is preferable, at least one of a methyl group and an ethyl group is more preferable, and a methyl group is further preferable. The plural alkyl groups included in a molecule of the branched low-molecular-weight siloxane may be identical to or different from one another.

Specific examples of the branched low-molecular-weight siloxane having a molecular weight of 200 or more and 600 or less include methyltris(trimethylsiloxy)silane (molecular formula: $C_{10}H_{30}O_3Si_4$), tetrakis(trimethylsiloxy)silane (molecular formula: $C_{12}H_{36}O_4Si_5$), and 1,1,1,3,5,5,7,7,7-nonamethyl-3-(trimethylsiloxy)tetrasiloxane (molecular formula: $C_{12}H_{36}O_4Si_5$).

An example of the low-molecular-weight siloxane having a molecular weight of 200 or more and 600 or less is a cyclic siloxane that includes a ring structure consisting of a siloxane bond.

Examples of a cyclic low-molecular-weight siloxane having a molecular weight of 200 or more and 600 or less include hexaalkylcyclotrisiloxane, octaalkylcyclotetrasiloxane, decaalkylcyclopentasiloxane, dodecaalkylcyclohexasiloxane, tetradecaalkylcycloheptasiloxane, and hexadecaalkylcyclooctasiloxane (note that, the above siloxanes have a molecular weight of 200 or more and 600 or less).

Examples of the alkyl group included in the above cyclic low-molecular-weight siloxanes include a linear alkyl group having 1 to 10 carbon atoms (preferably having 1 to 6 carbon atoms, more preferably having 1 to 3 carbon atoms, and further preferably having 1 or 2 carbon atoms); a branched alkyl group having 3 to 10 carbon atoms (preferably having 3 to 6 carbon atoms and more preferably having 3 or 4 carbon atoms); and a cyclic alkyl group having 3 to 10 carbon atoms (preferably having 3 to 6 carbon atoms and more preferably having 3 or 4 carbon atoms). Among these, an alkyl group having 1 to 3 carbon atoms is preferable, at least one of a methyl group and an ethyl group is more preferable, and a methyl group is further preferable. The plural alkyl groups included in a molecule of the cyclic low-molecular-weight siloxane may be identical to or different from one another.

Specific examples of the cyclic low-molecular-weight siloxane having a molecular weight of 200 or more and 600 or less include hexamethylcyclotrisiloxane, octamethylcyclotetrasiloxane, decamethylcyclopentasiloxane, dodecamethylcyclohexasiloxane, tetradecamethylcycloheptasiloxane, and hexadecamethylcyclooctasiloxane.

The low-molecular-weight siloxane having a molecular weight of 200 or more and 600 or less is preferably at least one selected from the group consisting of the linear low-molecular-weight siloxane and the branched low-molecular-weight siloxane, is more preferably the branched low-molecular-weight siloxane, and is further preferably a low-molecular-weight siloxane having a tetrakis structure in order to facilitate the migration of the released oil. The term "siloxane having a tetrakis structure" used herein refers to a siloxane including at least one structure represented by the following formula (i.e., a tetrakissiloxysilane structure) per molecule.

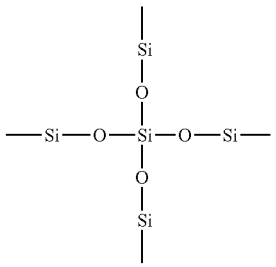

An example of the low-molecular-weight siloxane having a molecular weight of 200 or more and 600 or less and including a tetrakis structure is tetrakis(trialkylsiloxy)silane. Examples of the alkyl group included in the low-molecular-weight siloxane having a tetrakis structure include a linear alkyl group having 1 to 10 carbon atoms (preferably having 1 to 6 carbon, atoms, more preferably having 1 to 3 carbon atoms, and further preferably having 1 or 2 carbon atoms); a branched alkyl group having 3 to 10 carbon atoms (preferably having 3 to 6 carbon atoms and more preferably having 3 or 4 carbon atoms); and a cyclic alkyl group having 3 to 10 carbon atoms (preferably having 3 to 6 carbon atoms and more preferably having 3 or 4 carbon atoms). Among these, an alkyl group having 1 to 3 carbon atoms is preferable, at least one of a methyl group and an ethyl group is more preferable, and a methyl group is further preferable. The alkyl groups included in a molecule of the low-molecular-weight siloxane having a tetrakis structure may be identical to or different from one another.

The low-molecular-weight siloxane having a molecular weight of 200 or more and 600 or less is particularly preferably tetrakis(trimethylsiloxy)silane in order to facilitate the migration of the released oil.

The total amount of the low-molecular-weight siloxane having a molecular weight of 200 or more and 600 or less included in the toner is preferably, by mass, 0.01 ppm or more, is more preferably 0.05 ppm or more, and is further preferably 0.1 ppm or more of the amount of the toner in order to facilitate the migration of the released oil.

The total amount of the low-molecular-weight siloxane having a molecular weight of 200 or more and 600 or less included in the toner is preferably, by mass, 10 ppm or less, is more preferably 5 ppm or less, is further preferably 1 ppm or less, and is most preferably 0.5 ppm or less of the amount of the toner in order to reduce the likelihood of the siloxane molecules becoming entangled with one another to form clusters.

Note that, "ppm" is the abbreviation for parts per million.

The total amount of the low-molecular-weight siloxane having a molecular weight of 200 or more and 600 or less included in the toner is measured by a headspace method with a gas chromatograph mass spectrometer "GCMS-QP2020" produced by Shimadzu Corporation and a nonpolar column "Rtx-1, 10157" produced by Restek (thickness: 1.00 μm, length: 60 m, inside diameter: 0.32 mm). The specific measuring method is as described below.

The toner is charged into a vial. The vial is sealed with a cap and heated to 190° C. over 3 minutes. Subsequently, the volatile component inside the vial is introduced to the column. The low-molecular-weight siloxane having a molecular weight of 200 or more and 600 or less is detected under the following conditions.

Carriers gas type: Helium

Carriers gas pressure: 120 kPa (constant pressure)

Oven temperature: 40° C. (5 minutes)→(15° C./min)→250° C. (6 minutes) (25 minutes in total)

Ion source temperature: 260° C.

Interface temperature: 260° C.

A calibration curve is prepared using reference solutions having different concentrations which are prepared by diluting a reference substance (tetrakis(trimethylsiloxy)silane1) with ethanol. The content of the low-molecular-weight siloxane is determined on the basis of the area of the peak corresponding to the low-molecular-weight siloxane having a molecular weight of 200 or more and 600 or less which occurs in the chromatograph of the sample and the calibration curve of the reference substance. In the case where plural peaks corresponding to the low-molecular-weight siloxane having a molecular weight of 200 or more and 600 or less occur in the chromatograph of the sample, the content of the low-molecular-weight siloxane is determined on the basis of the total area of the peaks and the calibration curve of the reference substance. Furthermore, the ratio (ppm) of the total amount of the low-molecular-weight siloxane having a molecular weight of 200 or more and 600 or less included in the toner to the total amount of the toner is calculated.

The total amount of the low-molecular-weight siloxane having a molecular weight of 200 or more and 600 or less included in the toner is preferably, by mass, 1 ppm or more, is more preferably 5 ppm or more, is further preferably 10 ppm or more, is particularly preferably 15 ppm or more, and is most preferably 20 ppm or more of the total amount of the aggregated silica particles A and the silica particles B included in the toner in order to facilitate the migration of the released oil.

The total amount of the low-molecular-weight siloxane having a molecular weight of 200 or more and 600 or less included in the toner is preferably, by mass, 1,000 ppm or less, is more preferably 500 ppm or less, is further preferably 200 ppm or less, is particularly preferably 100 ppm or less, and is most preferably 50 ppm or less of the total amount of the aggregated silica particles A and the silica particles B included in the toner in order to reduce the likelihood of the siloxane molecules becoming entangled with one another to form clusters.

The above mass proportions are calculated by converting [Total amount of low-molecular-weight siloxane having molecular weight of 200 or more and 600 or less included in toner]/[Total amount of aggregated silica particles A and silica particles B included in toner] into parts per million.

The masses of the aggregated silica particles A and the silica particles B are the masses of the silica particles that have been subjected to a hydrophobic treatment, that is, include the mass of the component derived from the hydrophobizing agent used for the hydrophobic treatment.

The total amount of the aggregated silica particles A and the silica particles B included in the toner is determined by the following measuring method.

The toner is dispersed in water containing a surfactant. To the resulting dispersion liquid, an ultrasonic wave is applied. Subsequently, the dispersion liquid is subjected to high-speed centrifugation. The resulting supernatant liquid is dried at normal temperature (23° C.±2° C.) to obtain the aggregated silica particles A and the silica particles B. The aggregated silica particles A and the silica particles B separated from the supernatant are weighed. Although the low-molecular-weight siloxane may be deposited on the surfaces of the aggregated silica particles A and the silica particles B separated from the supernatant, the low-molecular-weight siloxane deposited on the surfaces of the aggregated silica particles A and the silica particles B is negligible because the mass of such a low-molecular-weight siloxane is negligibly smaller than the masses of the aggregated silica particles A and the silica particles B.

The low-molecular-weight siloxane having a molecular weight of 200 or more and 600 or less may be added to the toner by, for example, being externally added to the toner particle; or by being used as a surface-treating agent for the aggregated silica particles A and the silica particles B (specifically, the silica particles B) that serve as external additives.

Method for Producing Toner

The toner according to the exemplary embodiment is produced by, after the preparation of the toner particles, depositing an external additive on the surfaces of the toner particles.

The toner particles may be prepared by any dry process, such as knead pulverization, or any wet process, such as aggregation coalescence, suspension polymerization, or dissolution suspension. However, a method for preparing the toner particles is not limited thereto, and any suitable method known in the related art may be used. Among these methods, aggregation coalescence may be used in order to prepare the toner particles.

Specifically, in the case where, for example, aggregation coalescence is used in order to prepare the toner particles, the toner particles are prepared by the following steps:

preparing a resin particle dispersion liquid in which resin particles serving as a binder resin are dispersed (i.e., resin particle dispersion liquid preparation step);

causing the resin particles (and, as needed, other particles) to aggregate together in the resin particle dispersion liquid (or in the resin particle dispersion liquid mixed with another particle dispersion liquid as needed) in order to form aggregated particles (i.e., aggregated particle formation step);

and heating the resulting aggregated particle dispersion liquid in which the aggregated particles are dispersed in order to cause fusion and coalescence of the aggregated particles to occur and thereby form toner particles (fusion-coalescence step).

Each of the above steps is described below in detail.

Hereinafter, a method for preparing toner particles including a colorant and a release agent is described. However, it should be noted that the colorant and the release agent are optional. It is needless to say that additives other than a colorant and a release agent may be used.

Resin Particle Dispersion Liquid Preparation Step

In addition to a resin particle dispersion liquid in which resin particles serving as a binder resin is dispersed, for example, a colorant particle dispersion liquid in which colorant particles are dispersed and a release-agent particle dispersion liquid in which release-agent particles are dispersed are prepared.

The resin particle dispersion liquid is prepared by, for example, dispersing resin particles in a dispersion medium using a surfactant.

Examples of the dispersion medium used for preparing the resin particle dispersion liquid include aqueous media.

Examples of the aqueous media include water, such as distilled water and ion-exchange water; and alcohols. These aqueous media may be used alone or in combination of two or more.

Examples of the surfactant include anionic surfactants, such as sulfate-based surfactants, sulfonate-based surfactants, and phosphate-based surfactants; cationic surfactants, such as amine-salt-based surfactants and quaternary-ammonium-salt-based surfactants; and nonionic surfactants, such as polyethylene-glycol surfactants, alkylphenol-ethylene-oxide-adduct-based surfactants, and polyhydric-alcohol-based surfactants. Among these surfactants, in particular, the anionic surfactants and the cationic surfactants may be used. The nonionic surfactants may be used in combination with the anionic surfactants and the cationic surfactants.

These surfactants may be used alone or in combination of two or more.

In the preparation of the resin particle dispersion liquid, the resin particles can be dispersed in a dispersion medium by any suitable dispersion method commonly used in the related art in which, for example, a rotary-shearing homogenizer, a ball mill, a sand mill, or a dyno mill that includes media is used. Depending on the type of the resin particles used, the resin particles may be dispersed in the dispersion medium by, for example, phase-inversion emulsification. Phase-inversion emulsification is a method in which the resin to be dispersed is dissolved in a hydrophobic organic solvent in which the resin is soluble, a base is added to the resulting organic continuous phase (i.e., O phase) to perform neutralization, and subsequently an aqueous medium (i.e., W phase) is charged in order to perform phase inversion from W/O to O/W and disperse the resin in the aqueous medium in the form of particles.

The volume-average diameter of the resin particles dispersed in the resin particle dispersion liquid is preferably, for example, 0.01 μm or more and 1 μm or less, is more preferably 0.08 μm or more and 0.8 μm or less, and is further preferably 0.1 μm or more and 0.6 μm or less.

The volume-average diameter of the resin particles is determined in the following manner. The particle diameter distribution of the resin particles is obtained using a laser-diffraction particle-size-distribution measurement apparatus (e.g., "LA-700" produced by HORIBA, Ltd.). The particle diameter distribution measured is divided into a number of particle diameter ranges (i.e., channels). For each range, in ascending order in terms of particle diameter, the cumulative volume is calculated and plotted to draw a cumulative distribution curve. A particle diameter at which the cumulative volume reaches 50% is considered to be the volume particle diameter D50v. The volume-average diameters of particles included in the other dispersion liquids are also determined in the above-described manner.

The content of the resin particles included in the resin particle dispersion liquid is preferably 5% by mass or more and 50% by mass or less and is more preferably 10% by mass or more and 40% by mass or less.

The colorant particle dispersion liquid, the release-agent particle dispersion liquid, and the like are also prepared as in the preparation of the resin particle dispersion liquid. In other words, the above-described specifications for the volume-average diameter of the particles included in the resin particle dispersion liquid, the dispersion medium of the resin particle dispersion liquid, the dispersion method used for preparing the resin particle dispersion liquid, and the content of the particles in the resin particle dispersion liquid can also be applied to colorant particles dispersed in the colorant particle dispersion liquid and release-agent particles dispersed in the release-agent particle dispersion liquid.

Aggregated Particle Formation Step

The resin particle dispersion liquid is mixed with the colorant particle dispersion liquid and the release-agent particle dispersion liquid.

In the resulting mixed dispersion liquid, heteroaggregation of the resin particles with the colorant particles and the release-agent particles is performed in order to form aggregated particles including the resin particles, the colorant particles, and the release-agent particles, the aggregated particles having a diameter close to that of the desired toner particles.

Specifically, for example, a flocculant is added to the mixed dispersion liquid, and the pH of the mixed dispersion liquid is controlled to be acidic (e.g., pH of 2 or more and 5 or less). A dispersion stabilizer may be added to the mixed dispersion liquid as needed. Subsequently, the mixed dispersion liquid is heated to a temperature close to the glass transition temperature of the resin particles (specifically, e.g., [glass transition temperature of the resin particles −30° C.] or more and [the glass transition temperature −10° C.] or less), and thereby the particles dispersed in the mixed dispersion liquid are caused to aggregate together to form aggregated particles.

In the aggregated particle formation step, alternatively, for example, the above flocculant may be added to the mixed dispersion liquid at room temperature (e.g., 25° C.) while the mixed dispersion liquid is stirred using a rotary-shearing homogenizer. Then, the pH of the mixed dispersion liquid is controlled to be acidic (e.g., pH of 2 or more and 5 or less), and a dispersion stabilizer may be added to the mixed dispersion liquid as needed. Subsequently, the mixed dispersion liquid is heated in the above-described manner.

Examples of the flocculant include surfactants, inorganic metal salts, and divalent or higher metal complexes that have a polarity opposite to that of the surfactant included in the mixed dispersion liquid. Using a metal complex as a flocculant reduces the amount of surfactant used and, as a result, charging characteristics may be enhanced.

An additive capable of forming a complex or a bond similar to a complex with the metal ions contained in the flocculant may optionally be used in combination with the flocculant. An example of the additive is a chelating agent.

Examples of the inorganic metal salts include metal salts, such as calcium chloride, calcium nitrate, barium chloride, magnesium chloride, zinc chloride, aluminum chloride, and aluminum sulfate; and inorganic metal salt polymers, such as polyaluminum chloride, polyaluminum hydroxide, and calcium polysulfide.

The chelating agent may be a water-soluble chelating agent. Examples of such a chelating agent include oxycarboxylic acids, such as tartaric acid, citric acid, and gluconic acid; and aminocarboxylic acids, such as iminodiacetic acid (IDA), nitrilotriacetic acid (NTA), and ethylenediaminetetraacetic acid (EDTA).

The amount of the chelating agent used is preferably 0.01 parts by mass or more and 5.0 parts by mass or less and is more preferably 0.1 parts by mass or more and less than 3.0 parts by mass relative to 100 parts by mass of the resin particles.

Fusion-Coalescence Step

The aggregated particle dispersion liquid in which the aggregated particles are dispersed is heated to, for example, the glass transition temperature of the resin particles or more (e.g., temperature higher than the glass transition temperature of the resin particles by 10° C. to 30° C.) in order to perform fusion and coalescence of the aggregated particles. Hereby, toner particles are prepared.

The toner particles are prepared through the above-described steps.

It is also possible to prepare the toner particles by, after preparing the aggregated particle dispersion liquid in which the aggregated particles are dispersed, further mixing the aggregated particle dispersion liquid with a resin particle dispersion liquid in which resin particles are dispersed and subsequently performing aggregation such that the resin particles are deposited on the surfaces of the aggregated particles in order to form second aggregated particles; and by heating the resulting second-aggregated particle dispersion liquid in which the second aggregated particles are dispersed and thereby causing fusion and coalescence of the second aggregated particles to occur in order to form toner particles having a core-shell structure.

After the completion of the fusion-coalescence step, the toner particles formed in the solution are subjected to any suitable cleaning step, solid-liquid separation step, and drying step that are known in the related art in order to obtain dried toner particles. In the cleaning step, the toner particles may be subjected to displacement washing using ion-exchange water to a sufficient degree from the viewpoint of electrification characteristics. Examples of a solid-liquid separation method used in the solid-liquid separation step include suction filtration and pressure filtration from the viewpoint of productivity. Examples of a drying method used in the drying step include freeze-drying, flash drying, fluidized drying, and vibrating fluidized drying from the viewpoint of productivity.

The toner according to the exemplary embodiment is produced by, for example, adding an external additive to the dried toner particles and mixing the resulting toner particles using a V-blender, a Henschel mixer, a Lodige mixer, or the like. Optionally, coarse toner particles may be removed using a vibrating screen classifier, a wind screen classifier, or the like.

Electrostatic-Image Developer

An electrostatic-image developer according to the exemplary embodiment includes at least the toner according to the exemplary embodiment.

The electrostatic-image developer according to the exemplary embodiment may be a monocomponent developer including only the toner according to the exemplary embodiment or may be a two-component developer that is a mixture of the toner and a carrier.

The type of the carrier is not limited, and any suitable carrier known in the related art may be used. Examples of the carrier include a coated carrier prepared by coating the surfaces of cores including magnetic powder particles with a resin; a magnetic-powder-dispersed carrier prepared by dispersing and mixing magnetic powder particles in a matrix resin; and a resin-impregnated carrier prepared by impregnating a porous magnetic powder with a resin. The magnetic-powder-dispersed carrier and the resin-impregnated carrier may also be prepared by coating the surfaces of particles constituting the carrier, that is, core particles, with a resin.

Examples of the magnetic powder include powders of magnetic metals, such as iron, nickel, and cobalt; and powders of magnetic oxides, such as ferrite and magnetite.

Examples of the coat resin and the matrix resin include polyethylene, polypropylene, polystyrene, poly(vinyl acetate), poly(vinyl alcohol), poly(vinyl butyral), poly(vinyl chloride), poly(vinyl ether), poly(vinyl ketone), a vinyl chloride-vinyl acetate copolymer, a styrene-acrylic acid ester copolymer, a straight silicone resin including an organosiloxane bond and the modified products thereof, a fluorine resin, polyester, polycarbonate, a phenolic resin, and an epoxy resin. The coat resin and the matrix resin may optionally include additives, such as conductive particles. Examples of the conductive particles include particles of metals, such as gold, silver, and copper; and particles of carbon black, titanium oxide, zinc oxide, tin oxide, barium sulfate, aluminum borate, and potassium titanate.

The surfaces of the cores can be coated with a resin by, for example, using a coating-layer forming solution prepared by dissolving the coat resin and, as needed, various types of additives in a suitable solvent. The type of the solvent is not limited and may be selected with consideration of the type of the resin used, ease of applying the coating-layer forming solution, and the like.

Specific examples of a method for coating the surfaces of the cores with the coat resin include an immersion method in which the cores are immersed in the coating-layer forming solution; a spray method in which the coating-layer forming solution is sprayed onto the surfaces of the cores; a fluidized-bed method in which the coating-layer forming solution is sprayed onto the surfaces of the cores while the cores are floated using flowing air; and a kneader-coater method in which the cores of the carrier are mixed with the coating-layer forming solution in a kneader coater and subsequently the solvent is removed.

The mixing ratio (i.e., mass ratio) of the toner to the carrier in the two-component developer is preferably toner: carrier=1:100 to 30:100 and is more preferably 3:100 to 20:100.

Toner Cartridge

A toner cartridge according to the exemplary embodiment is a toner cartridge that includes the toner according to the exemplary embodiment and is detachably attachable to an image forming apparatus. The toner cartridge is a container that accommodates a replacement toner that is to be fed into the developing unit included in the image forming apparatus.

An example of the toner cartridge according to the exemplary embodiment is a rotary toner cartridge that includes a rotatable main body that includes a toner. FIG. 1 is a schematic diagram illustrating a rotary toner bottle, which is an example of the rotary toner cartridge. The rotary toner bottle 200 illustrated in FIG. 1 includes a bottle main body 202, a lid 204, and a gear 206.

The bottle main body 202 is hollow cylindrical and includes an uneven portion 220 formed in the side surface, which is used for transporting the replacement toner to the discharge port. A protrusion 210 formed in the uneven portion 220 extends continuously from the position around the bottom surface of the bottle main body 202 toward the lid 204 in a helical pattern. The protrusion 210 is formed so as to be protruded when viewed from the inside of the bottle main body 202. The protrusion 210 may be single helical or multi-helical. The portion interposed between two adjacent portions of the protrusion 210 appears as a recess when viewed from the inside of the bottle main body 202. The width of the protrusion 210 (i.e., the length of the protrusion 210 in the direction of the axis Q) is desirably smaller than the width of the adjacent recesses (i.e., the length of the recesses in the direction of the axis Q) in order to make it easy to transport the replacement toner toward the lid 204 inside the bottle main body 202.

The bottle main body 202 is made of a resin or the like. Examples of the material constituting the bottle main body 202 include polyethylene terephthalate, a polyolefin, and a polyester. The bottle main body 202 and the gear 206 may be formed as a single piece. Alternatively, the bottle main body 202 and the gear 206 may be formed individually and subsequently joined with each other.

The lid 204 is disposed at one of the ends of the rotary toner bottle 200 in the direction of the axis Q. In the lid 204, a discharge port 209 through which the replacement toner is discharged and a shutter 208 for closing and opening the discharge port 209 are formed. When the shutter 208 is opened/closed, the discharge port 209 is opened/closed.

The gear 206 is a gear that engages with a driving gear included in the toner cartridge mounting unit of the image forming apparatus and is driven to rotate in accordance with the rotation of the driving gear when the rotary toner bottle 200 is attached to the toner cartridge mounting unit. The gear 206 is arranged concentrically with respect to the bottle main body 202. The gear 206 illustrated in FIG. 1 has a smaller outside diameter than the bottle main body 202. The outside diameter of the gear 206 may be equal to that of the bottle main body 202. The outside diameter of the gear 206 may be larger than that of the bottle main body 202.

Although the bottle main body 202 includes the uneven portion 220 in FIG. 1, the toner cartridge and the rotary toner bottle according to the exemplary embodiment are not limited to this. The side surface of the bottle main body 202 may be a smooth curved surface without any recesses when viewed from the outside of the bottle main body 202.

Although the protrusion 210 is formed as a part of the bottle main body 202 in FIG. 1, the toner cartridge and the rotary toner bottle according to the exemplary embodiment are not limited to this. The protrusion 210 and the bottle main body 202 may be formed as individual members. Examples of the individual member include a coiled member disposed directly on the inner surface of the bottle main body 202 so as to extend continuously from the position around the bottom surface of the bottle main body 202 toward the lid 204 in a helical pattern.

The width of the protrusion 210 (i.e., the length of the protrusion 210 in the direction of the axis Q) is, for example, 3 mm or more and 20 mm or less and is preferably 8 mm or more and 14 mm or less. The height of the protrusion 210 is, for example, 5 mm or more and 20 mm or less and is preferably 5 mm or more and 15 mm or less. The helical pitch of the protrusion 210 (i.e., the distance between two adjacent portions of the protrusion in the direction of the axis Q) is, for example, 10 mm or more and 70 mm or less and is preferably 25 mm or more and 55 mm or less.

The action taken when the rotary toner bottle 200 is attached to the toner cartridge mounting unit of the image forming apparatus is described below.

The rotary toner bottle 200 is attached to the toner cartridge mounting unit such that the gear 206 engages with the driving gear included in the toner cartridge mounting unit. Then, the shutter 208 is opened, and the rotary toner bottle 200 connects to the toner supply line of the image forming apparatus through the discharge port 209. When the driving gear of the toner cartridge mounting unit is rotated, the gear 206 is driven to rotate. Consequently, the bottle main body 202 is driven to rotate about the axis Q. As a result of the rotation of the bottle main body 202, the replacement toner is transported from the position around the bottom surface of the bottle main body 202 toward the lid 204 by the uneven portion 220. The replacement toner transported toward the lid 204 is discharged through the discharge port 209 and fed into the toner supply line of the image forming apparatus. The rotary toner bottle 200 is attached to, for example, the toner cartridge mounting unit of the image forming apparatus such that the axis Q extends in the horizontal direction.

Process Cartridge

A process cartridge according to the exemplary embodiment is a process cartridge detachably attachable to an image forming apparatus. The process cartridge including:

a developing unit that includes an electrostatic-image developer and develops an electrostatic image formed on a surface of an image holding member with the electrostatic-image developer to form a toner image;

a toner cartridge that includes the electrostatic-image developing toner according to the exemplary embodiment; and a toner supply line that connects the toner cartridge to the developing unit and feeds the electrostatic-image developing toner included in the toner cartridge into the developing unit.

The process cartridge according to the exemplary embodiment may include, in addition to the developing unit, the toner cartridge, and the toner supply line, at least one selected from an image holding member, a charging unit, an electrostatic-image formation unit, a transfer unit, and the like.

An example of the process cartridge according to the exemplary embodiment is described below. This exemplary embodiment is not limited to this.

Figure 2:
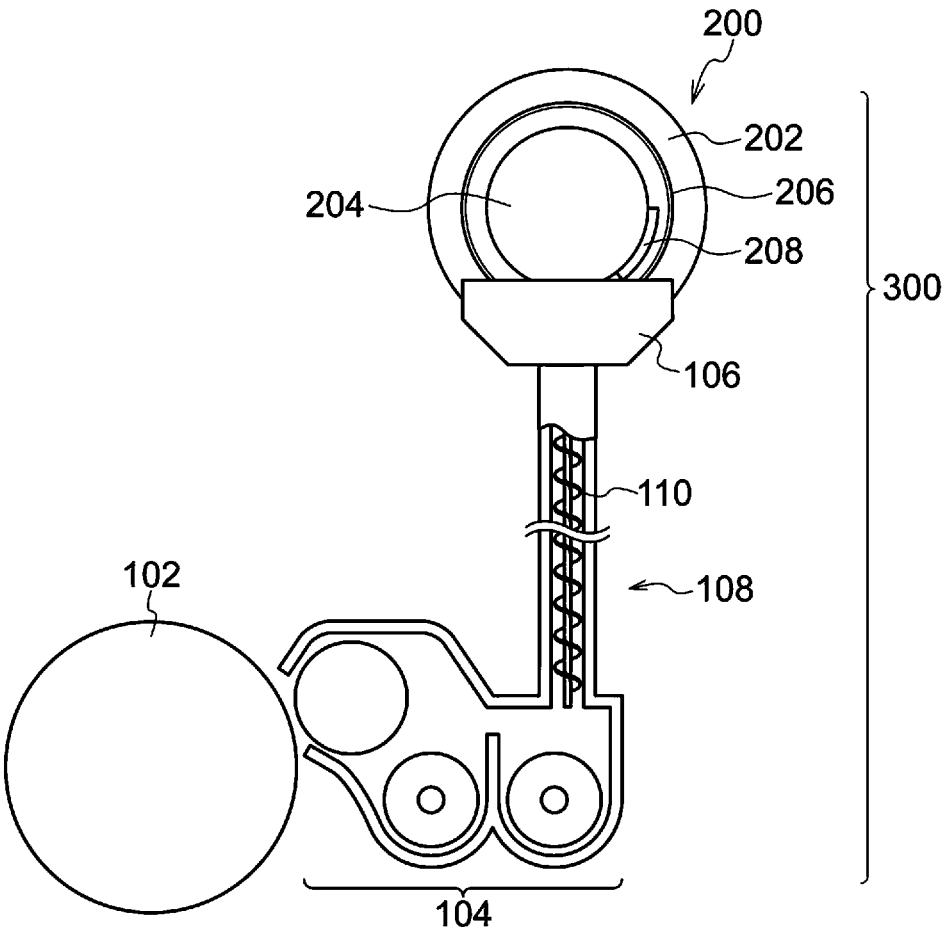
FIG. 2 is a schematic diagram illustrating an example of a process cartridge according to an exemplary embodiment.

FIG. 2 is a schematic diagram illustrating an example of the process cartridge according to the exemplary embodiment. The process cartridge 300 illustrated in FIG. 2 is detachably attachable to, for example, the image forming apparatus illustrated in FIG. 3.

The process cartridge 300 includes, a developing device 104 (an example of the developing unit), a toner supply line 108, and a toner cartridge 200. FIG. 2 also illustrates a photosensitive member 102 (example of the image holding member) that is to be disposed in the periphery of the process cartridge 300 when the process cartridge 300 is attached to an image forming apparatus.

The inside of the developing device 104 is, for example, divided into two chambers with a partition member. One of the chambers is provided with an outlet of the toner supply line 108 formed therein. The other chamber is provided with a developing roller arranged to face the photosensitive member 102. The two chambers are partially communicated with each other. Each of the chambers is provided with one stirring member disposed therein, which transports a developer while stirring the developer. The developer (not illustrated) included in the developing device 104 is transported and fed to the developing roller while being stirred with the two stirring members.

The toner supply line 108 is provided with a toner cartridge mounting unit 106 connected to one of the ends of the toner supply line 108, and the other end is connected to the developing device 104. An auger screw 110 (example of a toner transport mechanism) is disposed inside the toner supply line 108. The action of the auger screw 110 causes a toner to pass through the toner supply line 108. The toner transport mechanism, such as an auger screw, is not necessarily disposed inside the toner supply line 108; in the case where the toner transport mechanism is not disposed inside the toner supply line 108, for example, a toner is passed through the toner supply line 108 by free fall.

The toner cartridge mounting unit 106 is a unit that enables the toner cartridge 200 to be detachably attached to an image forming apparatus. The toner cartridge mounting unit 106 includes a toner receiving port communicated with a toner discharge port of the toner cartridge 200 and a rotation mechanism (e.g., gear) that rotates the toner cartridge 200.

The toner cartridge 200 includes the electrostatic-image developing toner according to the exemplary embodiment, which is stored inside the toner cartridge 200 and fed into the developing device 104 as a replacement toner. The toner cartridge 200 is, for example, a rotary toner bottle (example of the toner cartridge) and includes a bottle main body 202, a lid 204, a gear 206, and a shutter 208 for closing and opening the toner discharge port. The specific structure and action of the toner cartridge 200 are the same as those of the rotary toner bottle 200 described above.

The toner cartridge 200 is attached to the toner cartridge mounting unit 106 such that, for example, the longer axis of the toner cartridge 200 extends in the horizontal direction. The rotation mechanism (e.g., a gear) included in the toner cartridge mounting unit 106 rotates, for example, the toner cartridge 200 about a horizontal axis.

Image Forming Apparatus and Image Forming Method

An image forming apparatus according to the exemplary embodiment includes:

an image holding member;

a charging unit that charges a surface of the image holding member;

an electrostatic-image formation unit that forms an electrostatic image on the charged surface of the image holding member;

a developing unit that includes an electrostatic-image developer and develops the electrostatic image formed on the surface of the image holding member with the electrostatic-image developer to form a toner image;

a transfer unit that transfers the toner image formed on the surface of the image holding member onto a surface of a recording medium;

a fixing unit that fixes the toner image transferred on the surface of the recording medium;

a replacement toner accommodating unit that includes a replacement toner that is to be fed into the developing unit, the replacement toner accommodating unit including the electrostatic-image developing toner according to the exemplary embodiment; and a toner supply line that connects the replacement toner accommodating unit to the developing unit and feeds the electrostatic-image developing toner included in the replacement toner accommodating unit into the developing unit.

Using the image forming apparatus according to the exemplary embodiment, an image forming method (i.e., an image forming method according to the exemplary embodiment) that includes a charging step of charging a surface of the image holding member, an electrostatic-image formation step of forming an electrostatic image on the charged surface of the image holding member, a developing step of developing the electrostatic image formed on the surface of the image holding member with the electrostatic-image developer according to the exemplary embodiment to form a toner image, a transfer step of transferring the toner image formed on the surface of the image holding member onto a surface of a recording medium, a fixing step of fixing the toner image transferred on the surface of the recording medium, and a toner feeding step of feeding the electrostatic-image developing toner according to the exemplary embodiment included in the replacement toner accommodating unit from the replacement toner accommodating unit that includes the electrostatic-image developing toner into the developing unit through the toner supply line that connects the replacement toner accommodating unit to the developing unit is performed.

The image forming apparatus according to the exemplary embodiment may be any image forming apparatus known in the related art, such as a direct-transfer image forming apparatus in which a toner image formed on the surface of an image holding member is directly transferred to a recording medium; an intermediate-transfer image forming apparatus in which a toner image formed on the surface of an image holding member is transferred onto the surface of an intermediate transfer body in the first transfer step and the toner image transferred on the surface of the intermediate transfer body is transferred onto the surface of a recording medium in the second transfer step; an image forming apparatus including a cleaning unit that cleans the surface of an image holding member subsequent to the transfer of the toner image before the image holding member is again charged; and an image forming apparatus including a static-eliminating unit that eliminates static by irradiating the surface of an image holding member with static-eliminating light subsequent to the transfer of the toner image before the image holding member is again charged.

In the case where the image forming apparatus according to the exemplary embodiment is the intermediate-transfer image forming apparatus, the transfer unit may be constituted by, for example, an intermediate transfer body to which a toner image is transferred, a first transfer subunit that transfers a toner image formed on the surface of the image holding member onto the surface of the intermediate transfer body in the first transfer step, and a second transfer subunit that transfers the toner image transferred on the surface of the intermediate transfer body onto the surface of a recording medium in the second transfer step.

In the image forming apparatus according to the exemplary embodiment, for example, a portion including the developing unit may have a cartridge structure (i.e., process cartridge) detachably attachable to the image forming apparatus. An example of the process cartridge is a process cartridge including the electrostatic-image developer according to the exemplary embodiment and the developing unit.

An example of the image forming apparatus according to the exemplary embodiment is described below, but the image forming apparatus is not limited thereto. Hereinafter, only components illustrated in drawings are described; others are omitted.

Figure 3:
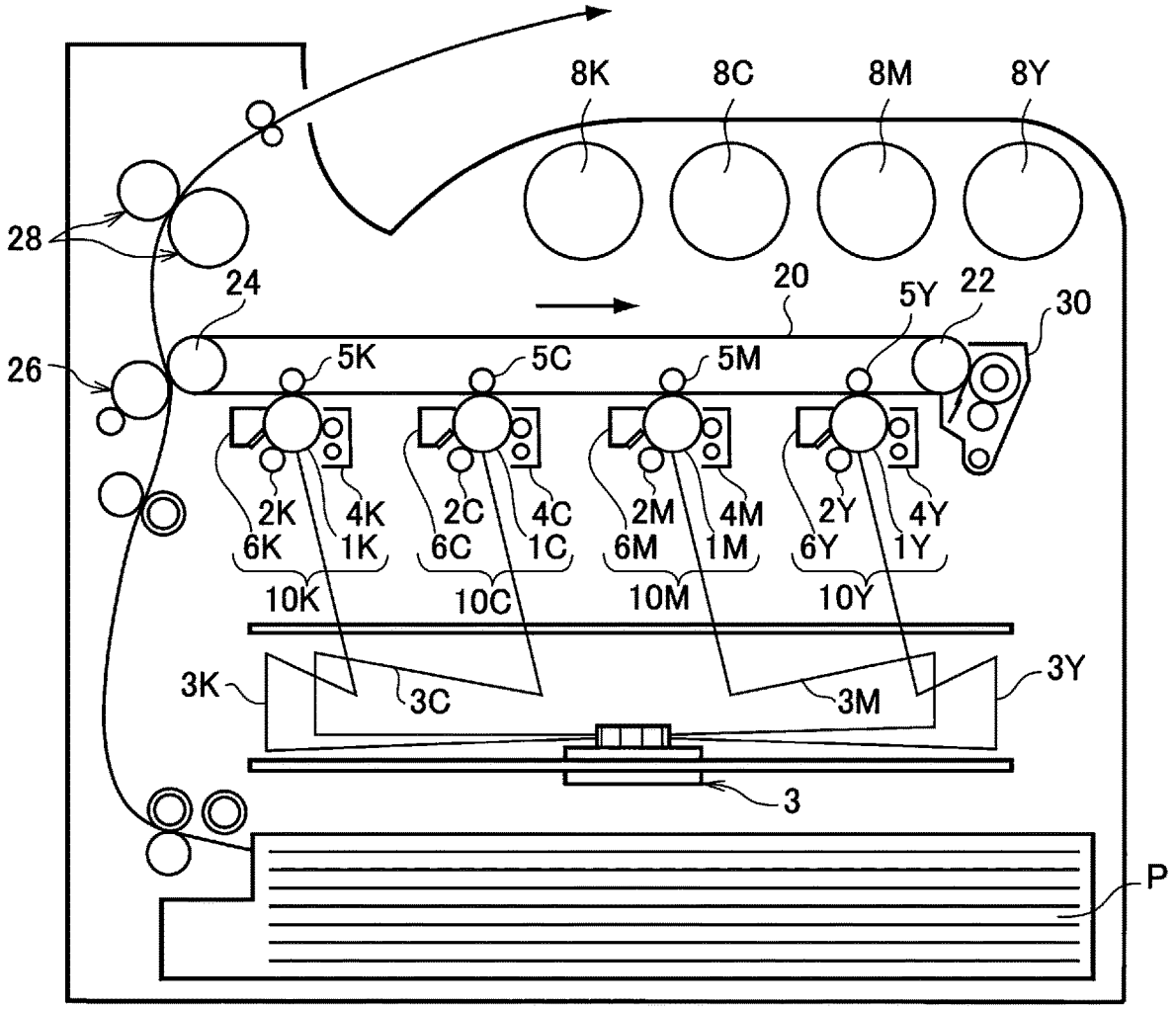
FIG. 3 is a schematic diagram illustrating an example of an image forming apparatus according to an exemplary embodiment.

FIG. 3 schematically illustrates the image forming apparatus according to the exemplary embodiment.

The image forming apparatus illustrated in FIG. 3 includes first to fourth electrophotographic image formation units 10Y, 10M, 10C, and 10K that form yellow (Y), magenta (M), cyan (C), and black (K) images, respectively, on the basis of color separation image data. The image formation units (hereinafter, may be referred to simply as "units") 10Y, 10M, 10C, and 10K are horizontally arranged in parallel at a predetermined distance from one another. The units 10Y, 10M, 10C, and 10K may be process cartridges detachably attachable to the image forming apparatus.

An intermediate transfer belt (example of the intermediate transfer body) 20 runs above and extends over the units 10Y, 10M, 10C, and 10K. The intermediate transfer belt 20 is wound around a drive roller 22 and a support roller 24 and runs clockwise in FIG. 3, that is, in the direction from the first unit 10Y to the fourth unit 10K. Using a spring or the like (not illustrated), a force is applied to the support roller 24 in a direction away from the drive roller 22, thereby applying tension to the intermediate transfer belt 20 wound around the drive roller 22 and the support roller 24. An intermediate transfer body-cleaning device 30 is disposed so as to come into contact with the image-carrier-side surface of the intermediate transfer belt 20 and to face the drive roller 22.

The image forming apparatus illustrated in FIG. 3 includes toner cartridges 8Y, 8M, 8C, and 8K (examples of the replacement toner accommodating unit) that are detachably attachable to the image forming apparatus. The developing devices 4Y, 4M, 4C, and 4K of the units 10Y, 10M, 10C, and 10K are connected to the toner cartridges 8Y, 8M, 8C, and 8K, respectively, with the toner supply lines (not illustrated). Yellow, magenta, cyan, and black toners are fed from the toner cartridges 8Y, 8M, 8C, and 8K into the developing devices 4Y, 4M, 4C, and 4K, respectively, through the toner supply lines. When the amount of toner contained in a toner cartridge is small, the toner cartridge is replaced.

Since the first to fourth units 10Y, 10M, 10C, and 10K have the same structure and the same action, the following description is made with reference to, as a representative, the first unit 10Y that forms an yellow image and is located upstream in a direction in which the intermediate transfer belt runs.

The first unit 10Y includes a photosensitive member 1Y serving as an image holding member. The following components are disposed around the photosensitive member 1Y sequentially in the counterclockwise direction: a charging roller (example of the charging unit) 2Y that charges the surface of the photosensitive member 1Y at a predetermined potential; an exposure device (example of the electrostatic-image formation unit) 3 that forms an electrostatic image by irradiating the charged surface of the photosensitive member 1Y with a laser beam 3Y based on a color separated image signal; a developing device (example of the developing unit) 4Y that develops the electrostatic image by supplying a charged toner to the electrostatic image; a first transfer roller (example of the first transfer subunit) 5Y that transfers the developed toner image to the intermediate transfer belt 20; and a photosensitive-member cleaning device (example of the cleaning unit) 6Y that removes a toner remaining on the surface of the photosensitive member 1Y after the first transfer.

The first transfer roller 5Y is disposed so as to be in contact with the inner surface of the intermediate transfer belt 20 and to face the photosensitive member 1Y. Each of the first transfer rollers 5Y, 5M, 5C, and 5K of the respective units is connected to a bias power supply (not illustrated) that applies a first transfer bias to the first transfer rollers. Each bias power supply varies the transfer bias applied to the corresponding first transfer roller on the basis of the control by a controller (not illustrated).

The action of forming a yellow image in the first unit 10Y is described below.

Before the action starts, the surface of the photosensitive member 1Y is charged at a potential of −600 to −800 V by the charging roller 2Y.

The photosensitive member 1Y is formed by stacking a photosensitive layer on a conductive substrate (e.g., volume resistivity at 20° C.: $1\times10^{-6}\Omega$ or less). The photosensitive layer is normally of high resistance (comparable with the resistance of ordinary resins), but, upon being irradiated with the laser beam, the specific resistance of the portion irradiated with the laser beam varies. Thus, the exposure device 3 irradiates the surface of the charged photosensitive member 1Y with the laser beam 3Y on the basis of the image data of the yellow image sent from the controller (not illustrated). As a result, an electrostatic image of yellow image pattern is formed on the surface of the photosensitive member 1Y.

The term "electrostatic image" used herein refers to an image formed on the surface of the photosensitive member 1Y by charging, the image being a "negative latent image" formed by irradiating a portion of the photosensitive layer with the laser beam 3Y to reduce the specific resistance of the irradiated portion such that the charges on the irradiated surface of the photosensitive member 1Y discharge while the charges on the portion that is not irradiated with the laser beam 3Y remain.

The electrostatic image, which is formed on the photosensitive member 1Y as described above, is sent to the predetermined developing position by the rotating photosensitive member 1Y. The electrostatic image on the photosensitive member 1Y is developed and visualized in the form of a toner image by the developing device 4Y at the developing position.

The developing device 4Y includes an electrostatic-image developer including, for example, at least, a yellow toner and a carrier. The yellow toner is stirred in the developing device 4Y to be charged by friction and supported on a developer roller (example of the developer support), carrying an electric charge of the same polarity (i.e., negative) as the electric charge generated on the photosensitive member 1Y. The yellow toner is electrostatically adhered to the eliminated latent image portion on the surface of the photosensitive member 1Y as the surface of the photosensitive member 1Y passes through the developing device 4Y. Thus, the latent image is developed using the yellow toner. The photosensitive member 1Y on which the yellow toner image is formed keeps rotating at the predetermined rate, thereby transporting the toner image developed on the photosensitive member 1Y to the predetermined first transfer position.

Upon the yellow toner image on the photosensitive member 1Y reaching the first transfer position, first transfer bias is applied to the first transfer roller 5Y so as to generate an electrostatic force on the toner image in the direction from the photosensitive member 1Y toward the first transfer roller 5Y. Thus, the toner image on the photosensitive member 1Y is transferred to the intermediate transfer belt 20. The transfer bias applied has the opposite polarity (+) to that of the toner (−) and controlled to be, in the first unit 10Y, for example, +10 μA by a controller (not illustrated).

The toner remaining on the photosensitive member 1Y is removed by the photosensitive-member cleaning device 6Y and then collected.

Each of the first transfer biases applied to first transfer rollers 5M, 5C, and 5K of the second, third, and fourth units 10M, 10C, and 10K is controlled in accordance with the first unit 10Y.

Thus, the intermediate transfer belt 20, on which the yellow toner image is transferred in the first unit 10Y, is successively transported through the second to fourth units 10M, 10C, and 10K while toner images of the respective colors are stacked on top of another.

The resulting intermediate transfer belt 20 on which toner images of four colors are multiple-transferred in the first to fourth units is then transported to a second transfer section including a support roller 24 being in contact with the inner surface of the intermediate transfer belt 20 and a second transfer roller (example of the second transfer subunit) 26 disposed on the image-carrier-side of the intermediate transfer belt 20. A recording paper (example of the recording medium) P is fed by a feed mechanism into a narrow space between the second transfer roller 26 and the intermediate transfer belt 20 that are brought into contact with each other at the predetermined timing. The second transfer bias is then applied to the support roller 24. The transfer bias applied here has the same polarity (−) as that of the toner (−) and generates an electrostatic force on the toner image in the direction from the intermediate transfer belt 20 toward the recording paper P. Thus, the toner image on the intermediate transfer belt 20 is transferred to the recording paper P. The intensity of the second transfer bias applied is determined on the basis of the resistance of the second transfer section which is detected by a resistance detector (not illustrated) that detects the resistance of the second transfer section and controlled by changing voltage.

Subsequently, the recording paper P is transported into a nip part of the fixing device (example of the fixing unit) 28 at which a pair of fixing rollers are brought into contact with each other. The toner image is fixed to the recording paper P to form a fixed image.

Examples of the recording paper P to which a toner image is transferred include plain paper used in electrophotographic copiers, printers, and the like. Instead of the recording paper P, OHP films and the like may be used as a recording medium.

The surface of the recording paper P may be smooth in order to enhance the smoothness of the surface of the fixed image. Examples of such a recording paper include coated paper produced by coating the surface of plain paper with resin or the like and art paper for printing.

The recording paper P, to which the color image has been fixed, is transported toward an exit portion. Thus, the series of the steps for forming a color image are terminated.

EXAMPLES

Details of the exemplary embodiment of the present disclosure are described below with reference to Examples below. The exemplary embodiment of the present disclosure is not limited to Examples below. Hereinafter, the terms "part" and "%" are on a mass basis unless otherwise specified.

Preparation of Toner Particles (1)

Preparation of Polyester Resin Particle Dispersion Liquid (1)

Ethylene glycol: 37 parts
Neopentyl glycol: 65 parts
1,9-Nonanediol: 32 parts
Terephthalic acid: 96 parts The above materials are charged into a flask and heated to 200° C. over 1 hour. After it has been confirmed that the inside of the reaction system has been stirred, 1.2 parts of dibutyltin oxide is charged into the flask. While the product water is removed by distillation, the temperature is increased from 200° C. to 240° C. over 6 hours and a dehydration condensation reaction is continued for 4 hours at 240° C.

Hereby, a polyester resin (1) having an acid value of 9.4 mgKOH/g, a weight-average molecular weight of 13,000, and a glass transition temperature of 62° C. is prepared.

While the polyester resin (1) is in a molten state, the polyester resin (1) is transferred to a "CAVITRON CD1010" produced by EUROTEC at a rate of 100 parts/min. A 0.37%-dilute ammonia water prepared separately is also transferred to the CAVITRON CD1010 at a rate of 0.1 L/min while being heated to 120° C. with a heat exchanger. The CAVITRON CD1010 is operated with a rotor rotation speed of 60 Hz and a pressure of 5 kg/cm$^2$. Hereby, a polyester resin particle dispersion liquid (1) having a solid content of 30% by mass is prepared. The volume-average size of the resin particles included in the polyester resin particle dispersion liquid (1) is 160 nm.

Preparation of Colorant Particle Dispersion Liquid (1)

Cyan pigment (copper phthalocyanine, C.I. Pigment blue 15:3, produced by Dainichiseika Color & Chemicals Mfg. Co., Ltd.): 10 parts Anionic surfactant (NEOGEN SC, produced by DKS Co. Ltd.): 2 parts Ion-exchange water: 80 parts The above materials are mixed with one another. The resulting mixture is subjected to a dispersion treatment using a high-pressure-impact-type disperser Ultimaizer "HJP30006" produced by Sugino Machine Limited for 1 hour to form a colorant particle dispersion liquid (1) having a solid content of 20% by mass. The volume-average size of the colorant particles included in the colorant particle dispersion liquid (1) is 180 nm.

Preparation of Release-Agent Particle Dispersion Liquid (1)

Carnauba wax (RC-160, melting temperature: 84° C., produced by TOA KASEI Co., Ltd.): 50 parts Anionic surfactant (NEOGEN SC, produced by DKS Co. Ltd.): 2 parts Ion-exchange water: 200 parts The above materials are heated to 120° C. and subjected to a dispersion treatment using an ULTRA-TURRAX T50 produced by IKA. Subsequently, a dispersion treatment is performed using a pressure-discharge-type Gaulin homogenizer. Hereby, a release-agent particle dispersion liquid (1) having a solid content of 20% by mass is prepared. The volume-average size of the release-agent particles included in the release-agent particle dispersion liquid (1) is 200 nm.

Preparation of Toner Particles

Polyester resin particle dispersion liquid (1): 200 parts

Colorant particle dispersion liquid (1): 25 parts

Release-agent particle dispersion liquid (1): 30 parts

Polyaluminum chloride: 0.4 parts

Ion-exchange water: 100 parts

The above materials are charged into a stainless steel flask and subjected to a dispersion treatment using an ULTRA-TURRAX produced by IKA. Subsequently, the stainless steel flask is heated to 48° C. while the contents of the flask are stirred in an oil bath for heating. After holding has been performed at 48° C. for 30 minutes, 70 parts of the polyester resin particle dispersion liquid (1) is added to the flask.

After the pH of the system has been adjusted to be 8.0 using an aqueous sodium hydroxide solution having a concentration of 0.5 mol/L, the stainless steel flask is hermetically sealed and the stirrer shaft is magnetically sealed. While stirring is continued, the flask is heated to 90° C. and held for 3 hours. Subsequently, cooling is performed at a cooling rate of 2° C./min. Subsequent to filtration and cleaning with ion-exchange water, solid-liquid separation is performed by Nutsche suction filtration. The resulting solid component is again dispersed in ion-exchange water having a temperature of 30° C. The resulting dispersion liquid is stirred at a rotation speed of 300 rpm for 15 minutes in order to perform cleaning. This cleaning operation is further performed six times. When the pH of the filtrate reaches 7.54 and the electric conductivity of the filtrate reaches 6.5 μS/cm, solid-liquid separation is performed by Nutsche suction filtration using a filter paper. The resulting solid component is vacuum-dried to form toner particles (1). The volume-average size of the toner particles (1) is 5.8 μm.

Preparation of Aggregated Silica Particles A

Preparation of Aggregated Silica Particles A(1)

Step of Producing Gas-Phase Method Silica Particles

Silicon tetrachloride, a hydrogen gas, and an oxygen gas are mixed with one another in a mixing chamber of a firing burner. The resulting mixture is burnt at 1,000° C. or more and 3,000° C. or less. A silica powder is collected from the burnt gas. Hereby, aggregated silica particles (1) are prepared. The size of aggregates is adjusted by changing the amount of time during which the mixture is burnt.

Step of Surface Treatment of Aggregated Silica Particles

Into an evaporator, 100 parts of the aggregated silica particles (1) and 500 parts of ethanol are charged. The resulting mixture is stirred for 15 minutes while the temperature is maintained to be 40° C. Subsequently, 10 parts of a dimethyl silicone oil is charged into the evaporator and stirring is performed for 15 minutes. Another 10 parts of a dimethyl silicone oil is charged into the evaporator and stirring is performed for 15 minutes. Then, the temperature is increased to 90° C., and ethanol is removed by vacuum drying. The treated substance is taken from the evaporator and vacuum-dried at 120° C. for 30 minutes. Hereby, aggregated silica particles A(1) treated with an oil are prepared.

The particle-size number frequency distribution of the aggregated silica particles A(1) has two peaks; the first peak occurs at a particle size of 90 nm, and the second peak occurs at a particle size of 65 nm.

Preparation of Aggregated Silica Particles A(2)

With 250 parts of the aggregated silica particles (1), 100 parts of hexamethyldisilazane (HMDS), which serves as a hydrophobizing agent, is mixed. The resulting mixture is heated at 130° C. to react for 2 hours. Then, the temperature is increased to 150° C. and drying is performed. Hereby, aggregated silica particles A(2) rendered hydrophobic with HMDS are prepared.

Preparation of Aggregated Silica Particles A(3)

Aggregated silica particles are prepared as in the preparation of the aggregated silica particles (1) and treated with a dimethyl silicone oil. The aggregated silica particles are then disintegrated to an intended size by stirring at normal temperature. Hereby, aggregated silica particles A(3) are prepared.

Preparation of Silica Particles B

Preparation of Silica Particles B(1)

Silica Particle Formation Step

Into a glass reaction container equipped with a stirrer, a dropping nozzle, and a thermometer, 300 parts of methanol and 70 parts of 10% ammonia water are charged. The above materials are mixed with each other to form an alkali catalyst solution. After the temperature of the alkali catalyst solution has been adjusted to be 30° C., 60 parts of tetramethoxysilane (TMOS) and 1.7 parts of 10% ammonia water are added to the reaction container while the alkali catalyst solution is stirred. Hereby, a silica particle dispersion liquid is prepared. The addition of the TMOS and the addition of the 10% ammonia water are started at the same time. It takes 3 minutes to add the whole amounts of the TMOS and the 10% ammonia water dropwise to the reaction container. The silica particle dispersion liquid is concentrated using a rotary filter "R-fine" produced by Kotobuki Industries Co., Ltd. until the concentration of the solid component reaches 40% by mass. The concentrated silica particle dispersion liquid is used as a silica particle dispersion liquid (1).

Silica Particle Surface Treatment Step

To 250 parts of the silica particle dispersion liquid (1), 100 parts of hexamethyldisilazane (HMDS) that serves as a hydrophobizing agent is added. After the resulting mixture has been heated to 130° C. to react for 2 hours, drying is performed by heating at 150° C. Hereby, non-aggregated silica particles B(1) rendered hydrophobic with HMDS are prepared.

Preparation of Silica Particles B(2) and B(3)

Non-aggregated silica particles B(2) and B(3) are prepared as in the preparation of the silica particles B(1), except that the silica particle formation step is changed as described in Table 1.

Preparation of Silica Particles B(4)

To 250 parts of the silica particle dispersion liquid (1), 100 parts of hexamethyldisilazane (HMDS) that serves as a hydrophobizing agent is added. After the resulting mixture has been heated to 130° C. to react for 2 hours, drying is performed by heating at 150° C. Hereby, hydrophobic silica particles (S1) are prepared.

Subsequently, tetrakis(trimethylsiloxy)silane is prepared in an amount that is 0.020% by mass of the amount of the silica particle dispersion liquid (1). The tetrakis(trimethylsiloxy)silane is diluted 5 times with methanol and then added to the hydrophobic silica particles (S1). Subsequently, drying is performed while the inside of the reaction system is stirred at 80° C. Hereby, non-aggregated silica particles B(4) are prepared.

Preparation of Silica Particles B(5) and B(6)

Non-aggregated silica particles B(5) and B(6) are prepared as in the preparation of the silica particles B(4), except that the amount of the low-molecular-weight siloxane used in the silica particle surface treatment step is changed as described in Table 1.

Preparation of Silica Particles B(7)

The silica particle dispersion liquid (1) is dried to collect silica particles. Into an evaporator, 100 parts of the silica particles and 500 parts of ethanol are charged. The resulting mixture is stirred for 15 minutes while the temperature is maintained to be 40° C. Subsequently, 10 parts of a dimethyl silicone oil is charged into the evaporator and stirring is performed for 15 minutes. Another 10 parts of a dimethyl silicone oil is charged into the evaporator and stirring is performed for 15 minutes. Then, the temperature is increased to 90° C., and ethanol is removed by vacuum drying. The treated substance is taken from the evaporator and vacuum-dried at 120° C. for 30 minutes. Hereby, non-aggregated silica particles B(7) treated with an oil are prepared.

TABLE 1

| | Particle formation step | | | | | Surface treatment step | | | |
|---|---|---|---|---|---|---|---|---|---|
| | Alkali catalyst solution | | Particle formation conditions | | | Hydro- | Low-molecular-weight siloxane | | Average |
| No. | MeOH mass part | 10% $NH_3$ water mass part | Total amount of TMOS added mass part | Total amount 10% $NH_3$ water added mass part | Addition time minute | phobizing agent — | Name of chemical substance — | Proportion to silica particle disperion liquid mass % | primary particle size nm |
| B(1) | 300 | 70 | 60 | 1.7 | 3 | HMDS | — | 0 | 45 |
| B(2) | 300 | 70 | 100 | 1.7 | 3 | HMDS | — | 0 | 80 |
| B(3) | 300 | 70 | 180 | 1.7 | 3 | HMDS | — | 0 | 90 |
| B(4) | 300 | 70 | 60 | 1.7 | 3 | HMDS | Tetrakis(trimethylsiloxy)silane | 0.020 | 45 |
| B(5) | 300 | 70 | 60 | 1.7 | 3 | HMDS | Tetrakis(trimethylsiloxy)silane | 0.100 | 45 |
| B(6) | 300 | 70 | 60 | 1.7 | 3 | HMDS | Tetrakis(trimethylsiloxy)silane | 1 | 45 |
| B(7) | 300 | 70 | 60 | 1.7 | 3 | Silicone oil | — | 0 | 45 |

Preparation of Carrier

Ferrite particles (volume-average size: 36 μm): 100 parts

Toluene: 14 parts

Styrene-methyl methacrylate copolymer: 2 parts (polymerization mass ratio: 90:10, weight-average molecular weight: 80,000)

Carbon black "R330" produced by Cabot Corporation: 0.2 parts

Toluene, the styrene-methyl methacrylate copolymer, and carbon black are mixed with one another, and the resulting mixture is stirred with a stirrer for 10 minutes to form a dispersion liquid. The dispersion liquid and the ferrite particles are charged into a vacuum degassing kneader and then stirred at 60° C. for 30 minutes. While heating is performed, the pressure is reduced to perform degassing. Subsequently, drying is performed. Hereby, a carrier is prepared.

Example 1

Into a Henschel mixer, 100 parts of the toner particles (1) and the specific amounts of the aggregated silica particles A(1) and the silica particles B(1) described in Table 1 are charged. The resulting mixture is stirred at a peripheral speed of 30 m/sec for 15 minutes. Hereby, a toner is prepared.

The above toner and the carrier are charged into a V-blender at a mixing ratio of Toner:Carrier=10:100 (by mass), and the resulting mixture is stirred for 20 minutes to form a developer.

Examples 2 to 10 and Comparative Examples 1 to 4

Toners and developers are prepared as in Example 1, except that the type or amount of the aggregated silica particles A used and/or the type or amount of the silica particles B used are changed as described in Table 2.

Performance Evaluation

Each of the toners is evaluated in terms of the rate at which the toner is discharged from the cartridge (hereinafter, this rate is referred to as "discharge rate") and the amount of the toner remaining in the cartridge by the following method and criteria.

Into a transparent toner cartridge made of polyethylene terephthalate (PET), 310 g of the toner that is to be evaluated is charged. The toner cartridge is left to stand at 28° C. and a relative humidity of 85% for 17 hours for performing temperature and moisture conditioning. Subsequently, at 22° C. and a relative humidity of 15%, the toner cartridge is attached to a feeding device provided with a transport nozzle (i.e., a feeding device that feeds the toner from the toner cartridge to a toner container). The toner container is rotated and the feeding device is operated for 50 minutes. The rotation of the toner container and the operation of the feeding device are conducted under the following conditions:

Rotation speed of toner container: 30 rpm
Length of transport nozzle of feeding device: 70 mm
Pitch of screw disposed inside transport path: 12.5 mm
Outside diameter of transport screw: 10 mm
Diameter of shaft of transport screw: 4 mm
Rotation speed of transport screw: 62.4 rpm The average discharge rate (mg/s) between 5 and 15 minutes after the beginning of the operation and the amount of the toner remaining in the toner cartridge 50 minutes after the beginning of the operation are measured and classified as follows. Table 2 summarizes the results.

Average Discharge Rate

A: 350 mg/s or more
B: Less than 350 mg/s and 320 mg/s or more
C: Less than 320 mg/s and 280 mg/s or more
D: Less than 280 mg/s Amount of Toner Remaining A: Less than 25 g (does not interfere with the use of the toner)
B: 25 g or more and less than 50 g (does not interfere with the use of the toner)
C: 50 g or more (interferes with the use of the toner)

TABLE 2

| | Aggregated silica particles A | | | | | Silica particles B | | | | | | | | | | | | |
|---|---|---|---|---|---|---|---|---|---|---|---|---|---|---|---|---|---|---|
| | No. | Hydro-phobizing agent | Average particle size Da (nm) | Amount added relative to 100 parts of particles Ma (part) | Coverage (%) | No. | Hydro-phobizing agent | Low-molecular-weight siloxane | Average particle size Db (nm) | Amount added relative to 100 parts of particles Mb (part) | Particle size ratio Da/Db | Total amount Ma + Mb | Amount ratio Ma/Mb | Coverage with all external additives (%) | Proportion of grain size of 20 to 100 nm in grain size distribution of all external additives (%) | Content of low-molecular-weight siloxane (ppm) | Performance | |
| | | | | | | | | | | | | | | | | | Discharge rate | Amount of toner remaining |
| Comparative example 1 | A(3) | Silicone oil | 40 | 0.8 | 38 | B(1) | HMDS | — | 45 | 1.1 | 0.89 | 1.9 | 0.73 | 96 | 85 | Beyond detection | C | C |
| Comparative example 2 | A(2) | HMDS | 82 | 0.8 | 17 | B(1) | HMDS | — | 45 | 1.1 | 1.82 | 1.9 | 0.73 | 75 | 85 | Beyond detection | B | C |
| Comparative example 3 | A(1) | Silicone oil | 80 | 0.8 | 18 | B(7) | Silicone oil | — | 45 | 1.1 | 1.78 | 1.9 | 0.73 | 75 | 85 | Beyond detection | D | C |
| Comparative example 4 | A(1) | Silicone oil | 80 | 0.8 | 18 | B(3) | HMDS | — | 90 | 1.1 | 0.89 | 1.9 | 0.73 | 66 | 83 | Beyond detection | C | C |
| Example 1 | A(1) | Silicone oil | 80 | 0.8 | 18 | B(1) | HMDS | — | 45 | 1.1 | 1.78 | 1.9 | 0.73 | 76 | 85 | Beyond detection | A | B |
| Example 2 | A(1) | Silicone oil | 80 | 0.8 | 18 | B(2) | HMDS | — | 80 | 1.1 | 1.00 | 1.9 | 0.73 | 70 | 85 | Beyond detection | B | B |
| Example 3 | A(1) | Silicone oil | 80 | 0.8 | 18 | B(4) | HMDS | Tetrakis (trimethylsiloxy) silane | 45 | 1.1 | 1.78 | 1.9 | 0.73 | 75 | 85 | 0.13 | A | A |
| Example 4 | A(1) | Silicone oil | 80 | 0.8 | 18 | B(5) | HMDS | Tetrakis (trimethylsiloxy) silane | 45 | 1.1 | 1.78 | 1.9 | 0.73 | 75 | 85 | 0.48 | A | A |
| Example 5 | A(1) | Silicone oil | 80 | 0.8 | 18 | B(6) | HMDS | Tetrakis (trimethylsiloxy) silane | 45 | 1.1 | 1.78 | 1.9 | 0.73 | 75 | 85 | 1.00 | A | A |
| Example 6 | A(1) | Silicone oil | 80 | 0.8 | 18 | B(1) | HMDS | — | 45 | 0.82 | 1.78 | 1.62 | 0.98 | 70 | 85 | Beyond detection | B | A |
| Example 7 | A(1) | Silicone oil | 80 | 0.8 | 18 | B(1) | HMDS | — | 45 | 1.58 | 1.78 | 2.38 | 0.51 | 88 | 84 | Beyond detection | A | B |
| Example 8 | A(1) | Silicone oil | 80 | 0.25 | 6 | B(1) | HMDS | — | 45 | 0.5 | 1.78 | 0.75 | 0.50 | 60 | 84 | Beyond detection | C | C |
| Example 9 | A(1) | Silicone oil | 80 | 1.5 | 30 | B(1) | HMDS | — | 45 | 1.51 | 1.78 | 3.01 | 0.99 | 100 | 89 | Beyond detection | B | B |
| Example 10 | A(1) | Silicone oil | 80 | 0.7 | 14 | B(1) | HMDS | — | 45 | 0.75 | 1.78 | 1.45 | 0.93 | 66 | 90 | Beyond detection | C | B |

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An electrostatic-image developing toner comprising:

toner particles;

aggregated silica particles A treated with an oil; and aggregated or non-aggregated silica particles B rendered hydrophobic with a hydrophobizing agent other than an oil, wherein an average particle size Da of the aggregated silica particles A and an average particle size Db of the silica particles B satisfy Da≥Db, and wherein the electrostatic-image developing toner does not include any external additive other than the aggregated silica particles A or the silica particles B.

2. The electrostatic-image developing toner according to claim 1, wherein a ratio Da/Db of the average particle size Da to the average particle size Db is 1.0 or more and 2.0 or less.

3. The electrostatic-image developing toner according to claim 1, wherein a mass ratio Ma/Mb of a content Ma of the aggregated silica particles A to a content Mb of the silica particles B is 0.5 or more and 1.0 or less.

4. The electrostatic-image developing toner according to claim 1, wherein the silica particles B include non-aggregated particles that are wet-process silica particles.

5. The electrostatic-image developing toner according to claim 1, wherein the silica particles B include silica particles rendered hydrophobic with 1, 1, 1, 3, 3, 3-hexamethyldisilazane.

6. The electrostatic-image developing toner according to claim 1, wherein the aggregated silica particles A include aggregated particles that are gas-phase method silica particles.

7. The electrostatic-image developing toner according to claim 1, wherein the aggregated silica particles A include aggregated silica particles treated with a silicone oil.

8. The electrostatic-image developing toner according to claim 1, wherein a particle-size number frequency distribution of the aggregated silica particles A has first and second peaks, the first peak occurs at a particle size of 80 nm or more and 110 nm or less, and the second peak occurs at a particle size of 50 nm or more and 80 nm or less.

9. The electrostatic-image developing toner according to claim 1, wherein the average particle size Da is 70 nm or more and 110 nm or less.

10. The electrostatic-image developing toner according to claim 1, wherein the average particle size Db is 20 nm or more and 80 nm or less.

11. The electrostatic-image developing toner according to claim 1, wherein a coverage of the aggregated silica particles A on surfaces of the toner particles is 5% or more and 30% or less.

12. The electrostatic-image developing toner according to claim 1, wherein a coverage of all the external additives on surfaces of the toner particles is 60% or more and 100% or less.

13. The electrostatic-image developing toner according to claim 1, wherein, in a particle-size number frequency distribution of all the external additives, 75% or more of all the external additives have a particle size of 20 nm or more and 100 nm or less.

14. The electrostatic-image developing toner according to claim 1, further comprising tetrakis (trimethylsiloxy) silane.

15. The electrostatic-image developing toner according to claim 14, wherein a content of the tetrakis (trimethylsiloxy) silane is 0.01 ppm by mass or more and 10 ppm by mass or less.

16. An electrostatic-image developer comprising the electrostatic-image developing toner according to claim 1.

17. A toner cartridge detachably attachable to an image forming apparatus, the toner cartridge comprising the electrostatic-image developing toner according to claim 1.

18. The toner cartridge according to claim 17, that is a rotary toner cartridge that includes a rotatable main body that accommodates the electrostatic-image developing toner.

19. A process cartridge detachably attachable to an image forming apparatus, the process cartridge comprising:

a developing unit that includes an electrostatic-image developer and develops an electrostatic image formed on a surface of an image holding member with the electrostatic-image developer to form a toner image;

a toner cartridge that includes the electrostatic-image developing toner according to claim 1; and a toner supply line that connects the toner cartridge to the developing unit and feeds the electrostatic-image developing toner included in the toner cartridge into the developing unit.

20. An image forming apparatus comprising:

an image holding member;

a charging unit that charges a surface of the image holding member;

an electrostatic-image formation unit that forms an electrostatic image on the charged surface of the image holding member;

a developing unit that includes an electrostatic-image developer and develops the electrostatic image formed on the surface of the image holding member with the electrostatic-image developer to form a toner image;

a transfer unit that transfers the toner image formed on the surface of the image holding member onto a surface of a recording medium;

a fixing unit that fixes the toner image transferred on the surface of the recording medium;

a replacement toner accommodating unit that includes the electrostatic-image developing toner according to claim 1; and a toner supply line that connects the replacement toner accommodating unit to the developing unit and feeds the electrostatic-image developing toner included in the replacement toner accommodating unit into the developing unit.

21. An image forming method comprising:

charging a surface of an image holding member;

forming an electrostatic image on the charged surface of the image holding member;

developing the electrostatic image formed on the surface of the image holding member with an electrostatic-image developer to form a toner image;

transferring the toner image formed on the surface of the image holding member onto a surface of a recording medium;

fixing the toner image transferred on the surface of the recording medium; and feeding the electrostatic-image developing toner according to claim 1 included in a replacement toner accommodating unit from the replacement toner accommodating unit into a developing unit through a toner supply line that connects the replacement toner accommodating unit to the developing unit.

* * * * *